US011688245B2

(12) United States Patent
Xu et al.

(10) Patent No.: US 11,688,245 B2
(45) Date of Patent: Jun. 27, 2023

(54) SYSTEM AND METHOD OF PROVIDING A HOLD AND SPIN GAME WITH PLAYER SELECTED VOLATILITY

(71) Applicant: Aristocrat Technologies, Inc. (ATI), Las Vegas, NV (US)

(72) Inventors: Hua Xu, Marietta, GA (US); John Marcus Milliner, III, Alpharetta, GA (US)

(73) Assignee: ARISTOCRAT TECHNOLOGIES, INC., Las Vegas, NV (US)

( * ) Notice: Subject to any disclaimer, the term of this patent is extended or adjusted under 35 U.S.C. 154(b) by 0 days.

(21) Appl. No.: 17/373,321

(22) Filed: Jul. 12, 2021

(65) Prior Publication Data

US 2023/0018779 A1 Jan. 19, 2023

(51) Int. Cl.
*G07F 17/32* (2006.01)
*G07F 17/34* (2006.01)

(52) U.S. Cl.
CPC ..... *G07F 17/3267* (2013.01); *G07F 17/3262* (2013.01); *G07F 17/3288* (2013.01); *G07F 17/3213* (2013.01); *G07F 17/3225* (2013.01); *G07F 17/3251* (2013.01); *G07F 17/34* (2013.01)

(58) Field of Classification Search
CPC ..... G07F 17/3267; G07F 17/3262; G07F 17/3288; G07F 17/3213; G07F 17/3225; G07F 17/3251; G07F 17/34
See application file for complete search history.

(56) References Cited

U.S. PATENT DOCUMENTS

| | | | | |
|---|---|---|---|---|
| 7,070,501 | B2 | 7/2006 | Cormack | |
| 7,252,590 | B2 | 8/2007 | Palmer | |
| 8,360,851 | B2 | 1/2013 | Aoki | |
| 9,424,720 | B2 | 8/2016 | Suda | |
| 9,892,599 | B2 * | 2/2018 | Tam | G07F 17/3267 |
| 9,928,691 | B2 | 3/2018 | Olive | |
| 10,325,452 | B2 * | 6/2019 | Tam | G07F 17/3267 |

(Continued)

FOREIGN PATENT DOCUMENTS

| | | |
|---|---|---|
| AU | 2013202658 | 1/2014 |
| AU | 2013251288 A1 | 5/2014 |

(Continued)

OTHER PUBLICATIONS

Australian Examination Report for AU2017251772, dated Jun. 14, 2018, 3 pages.

(Continued)

*Primary Examiner* — Dmitry Suhol
*Assistant Examiner* — Jason Pinheiro
(74) *Attorney, Agent, or Firm* — McAndrews, Held & Malloy, Ltd.

(57) ABSTRACT

A gaming machine provides a spinning reel game having a base game, from which a hold and spin game is triggered when a determined quantity of configurable symbols are displayed in a base game outcome. When the feature game is triggered, volatility options are presented to the player. After receiving a volatility selection that specifies a first control factor for a hold and spin game, the gaming machine conducts the hold and spin game per the specified first control factor while using at least another control factor to maintain a same return-to-player across the volatility options.

20 Claims, 27 Drawing Sheets

(56) References Cited

U.S. PATENT DOCUMENTS

| | | | | |
|---|---|---|---|---|
| 2003/0013514 | A1 | 1/2003 | Cregan | |
| 2003/0036423 | A1 | 2/2003 | Vancura | |
| 2003/0216165 | A1 | 11/2003 | Singer | |
| 2004/0137982 | A1 | 7/2004 | Cuddy | |
| 2004/0147306 | A1 | 7/2004 | Randall | |
| 2006/0189369 | A1 | 8/2006 | Taylor | |
| 2006/0189378 | A1 | 8/2006 | Aoki | |
| 2007/0060248 | A1 | 3/2007 | Rodgers | |
| 2007/0117611 | A1 | 5/2007 | Dodge | |
| 2008/0090644 | A1 | 4/2008 | Marks | |
| 2008/0139285 | A1 | 6/2008 | Zimmermann | |
| 2009/0054129 | A1 | 2/2009 | Yoshimura | |
| 2009/0239634 | A1 | 9/2009 | Nguyen | |
| 2009/0286594 | A1 | 11/2009 | Walker | |
| 2010/0016055 | A1 | 1/2010 | Englman | |
| 2010/0056252 | A1 | 3/2010 | Englman | |
| 2010/0075737 | A1 | 3/2010 | Bluemel | |
| 2010/0210343 | A1 | 8/2010 | Englman | |
| 2010/0234092 | A1 | 9/2010 | Gomez | |
| 2012/0178517 | A1 | 7/2012 | Montenegro | |
| 2013/0331168 | A1 | 12/2013 | Street | |
| 2013/0331173 | A1* | 12/2013 | Jaffe | G07F 17/3267 463/20 |
| 2014/0274292 | A1 | 9/2014 | Suda | |
| 2014/0323198 | A1 | 10/2014 | Tuck | |
| 2014/0349734 | A1* | 11/2014 | Saunders | G07F 17/3213 463/20 |
| 2015/0080084 | A1* | 3/2015 | Saunders | G07F 17/3262 463/20 |
| 2015/0310699 | A1 | 10/2015 | Meyer | |
| 2016/0042597 | A1 | 2/2016 | Olive | |
| 2016/0049050 | A1 | 2/2016 | Berman | |
| 2016/0086431 | A1* | 3/2016 | Berman | G07F 17/3286 463/20 |
| 2016/0180637 | A1 | 6/2016 | Honeycutt | |
| 2016/0247361 | A1* | 8/2016 | Meyer | G07F 17/3225 |
| 2016/0253873 | A1 | 9/2016 | Olive | |
| 2017/0148274 | A1 | 5/2017 | Olive | |
| 2017/0154498 | A1 | 6/2017 | Olive | |
| 2018/0268655 | A1 | 9/2018 | Olive | |
| 2019/0295380 | A1* | 9/2019 | Casey | G07F 17/323 |
| 2020/0074791 | A1* | 3/2020 | Uberuaga | G07F 17/3267 |
| 2020/0334958 | A1* | 10/2020 | Davis | G07F 17/3267 |

FOREIGN PATENT DOCUMENTS

| | | | |
|---|---|---|---|
| AU | 2014202042 | A1 | 5/2014 |
| EP | 0984408 | | 3/2000 |

OTHER PUBLICATIONS

Notice of Allowance dated Mar. 3, 2021 for U.S. Appl. No. 14/861,704 (pp. 1-12).
Australian Examination Report No. 1 for Application No. AU2019204105, dated Mar. 3, 2020, 3 pages.
Office Action dated May 6, 2020 for U.S. Appl. No. 14/861,704 (pp. 1-13).
Australian Examination Report for AU2016100230, dated May 11, 2016, 5 pages.
Australian Examination Report for AU2015210489, dated Jun. 14, 2016, 5 pages.
Australian Examination Report for AU2016202727, dated Jul. 4, 2016, 5 pages.
Australian Examination Report for AU2017101097, dated Dec. 7, 2017. (3 pages).
Australian Examination Report for AU2017101629, dated Jan. 16, 2018, 3 pages.
Australian Examination Report for AU2017204560, dated Feb. 1, 2018, 3 pages.
Australian Examination Report for Application No. 2018278882, dated Dec. 9, 2019, 2 pages.
Konami All Aboard at https://www.youtube.com/watch?v=TWYdFMBIJRs (Video), last accessed Feb. 3, 2020.
All Aboard the Drop Test Drives at https://the-rop.com.au/the-drop-test-drives-komanis-all-aboard-hit-games/.
Office Action (Non-Final Rejection) dated Mar. 15, 2022 for U.S. Appl. No. 16/780,839 (pp. 1-14).
Australian Examination Report No. 1 issued in App. No. AU2021201368, dated May 10, 2022, 3 pages.
Office Action (Notice of Allowance and Fees Due (PTOL-85)) dated Sep. 21, 2022 for U.S. Appl. No. 16/780,839 (pp. 1-7).

* cited by examiner

SYSTEM AND METHOD OF PROVIDING A HOLD AND SPIN GAME WITH PLAYER SELECTED VOLATILITY

BACKGROUND

Electronic gaming machines or gaming devices provide a variety of wagering games such as slot games, video poker games, video blackjack games, roulette games, video bingo games, keno games that are frequently offered at casinos and other locations. Play on gaming machines typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific symbol combinations along predetermined paths (or paylines) through the matrix indicate the outcome of the game. The display typically highlights winning combinations/outcomes for ready identification by the player. Specific symbol combinations and their corresponding awards are usually shown in a "pay-table" which is available to the player for reference. Often, the player may vary his/her wager to include differing quantities of paylines and/or the amount bet on each line. By varying the wager, the player may sometimes alter the frequency or quantity of winning symbol combinations, frequency or quantity of secondary games, and/or the amount awarded.

Typical wagering games use a random number generator (RNG) to randomly determine the outcome of each game. The wagering game is designed to return a certain percentage of the amount wagered back to the player (i.e., return-to-player) over the course of many plays or instances of the game. The return-to-player and randomness of the RNG are critical to ensuring the fairness of the games and are, therefore, highly regulated. Upon initiation of play, the RNG randomly determines a game outcome and symbols are then selected which correspond to that outcome. Notably, some games may include an element of skill on the part of the player and are, therefore, not entirely random.

In existing gaming systems, feature games, secondary or bonus games, may be triggered for players in addition to the base game. A feature game gives players an additional opportunity to win prizes, or the opportunity to win larger prizes, than would otherwise be available in the base game. Feature games can also offer altered game play to enhance player enjoyment.

The popularity of such gaming machines is heavily dependent on the perceived entertainment value of the provided gaming experience. Operators of gaming businesses therefore demand the most entertaining, engaging, and exciting gaming machines so as to attract and retain patrons. To satisfy such demand, game developers are continuously inventing new gaming features. However, it is not enough for a new gaming feature to be entertaining, engaging, and exciting, the new gaming feature must also be realizable in a manner that satisfies regulatory requirements. As such, game developers must not only satisfy the entertainment side of creating a new gaming feature, but must also address the technical side. In particular, game developers must identify technical problems associated with implementing the new feature and create technical solutions in order to bring their creation to market. Thus, there is a not only continuing need for new gaming features that are entertaining but also a continuing need for the technical solutions needed to bring such gaming features to market.

SUMMARY

Embodiments provide a gaming machine, a method, and gaming system with a spinning reel game having a base game, from which a hold and spin game is triggered when a determined quantity of configurable symbols are displayed in a base game outcome. When the feature game is triggered, volatility options are presented to the player. After receiving a volatility selection that specifies a first control factor for a hold and spin game, the gaming machine conducts the hold and spin game per the specified first control factor while using at least another control factor to maintain a same return-to-player across the volatility options.

According to one embodiment, a gaming machine includes a player interface, a display system, and a control system. The display system includes one or more display devices. The control system includes one or more processors which execute instructions. Execution of the instructions cause the control system to present symbols of a base game outcome at display positions of the display system, and present volatility options via the player interface in response to the base game outcome triggering a feature game. The control system further receives, via the player interface, a volatility selection that selects a volatility option from the volatility options, wherein each volatility option specifies a different initial quantity of spins for the feature game. For each spin of the initial quantity of spins specified by the selected volatility option, the control system holds configurable symbols in a feature game outcome presented at display positions of the display system and provides the feature game outcome with replacement symbols that replace symbols at display positions of the display system that do not present a configurable symbol.

For each replacement symbol that is a configurable symbol, the control system selects a multiplier value and assigns the selected multiplier value to the respective configurable symbol, wherein the multiplier value is selected based on the selected volatility option to maintain a same return-to-player across the volatility options. The control system further presents an award for the respective configurable symbol based on a sum of values presented by the configurable symbols multiplied by the multiplier value assigned to the respective configurable symbol.

Per another embodiment, a method of a gaming machine having a player interface, display system, and a control system is provided. The method includes presenting, via the display system, a base game outcome comprising symbols at display positions of the display system, and triggering a feature game based on the base game outcome. After triggering the feature game, the method further includes receiving, via the player interface, a volatility selection that selects a volatility option from a plurality of volatility options that each uniquely specify a first control factor of a hold and spin game; and conducting, via the control system, the hold and spin game per the first control factor specified by the volatility selection and at least a second control factor that maintains a same return-to-player across the plurality of volatility options despite the plurality of volatility options each uniquely specifying the first control factor.

BRIEF DESCRIPTION OF THE DRAWINGS

Features and advantages of certain embodiments of the present disclosure will become apparent from the following description of embodiments thereof, by way of example only, with reference to the accompanying drawings, in which.

Figure 1:
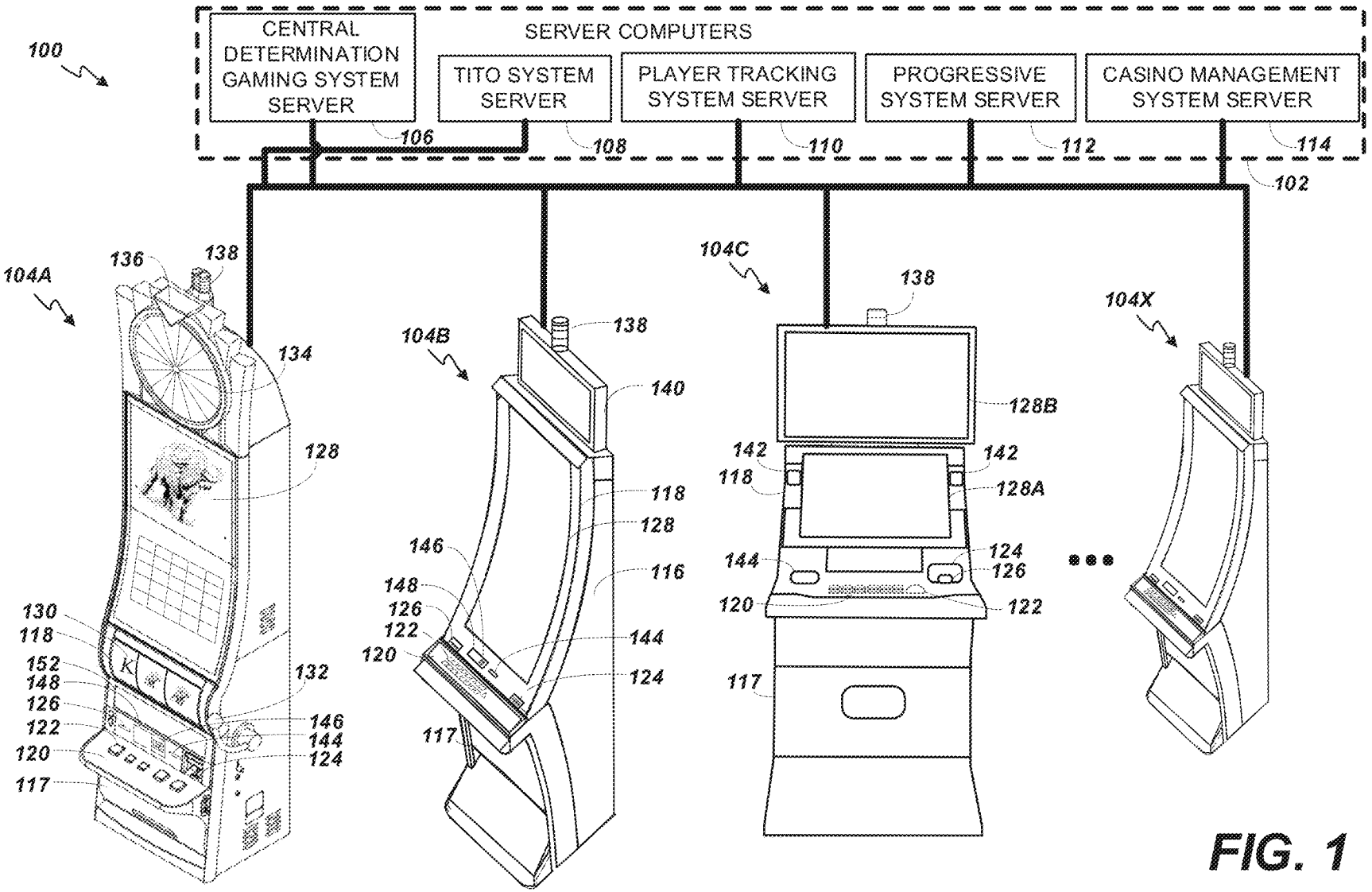
FIG. 1 is an example diagram showing several gaming machines networked with various gaming-related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present invention is not limited to the arrangements and instrumentality shown in the attached drawings.

DETAILED DESCRIPTION

The present disclosure is generally directed to solving various technical problems associated with gaming machines that provide games with player selectable volatility options. In some embodiments, a gaming machine may present a player with several volatility options from which the player may select. The gaming machine may then present the feature game per the selected volatility option. The feature game is a hold and spin feature game and the volatility option determines the starting quantity of spins and the reset spin amount. For example, a volatility option may correspond to a hold and spin game with a starting count of 3 spins and a reset count of 3. Another option may correspond to a hold and spin game with a starting count of 2 spins and a reset count of 2.

In some embodiments, volatility options may permit the player to adjust the frequency and size of awards provided by the feature game. For example, a low volatility option may provide small awards at a high frequency, a high volatility option may provide large awards at a low frequency, and a normal or medium volatility option may provide normal or baseline awards at a normal or baseline frequency. As explained in greater detail below, a gaming machine may be designed such that the return-to-player for each of the volatility options is the same. Namely, regardless of whether the player selects the low volatility option, the normal volatility option, or high volatility option, the player receives the same expected payout or return-to-player (e.g., 90%) over a significant quantity of plays of the game. To this end, various of the below disclosed embodiments explain how to adjust two or more factors in order to provide the requested volatility while retaining a desired return-to-player.

FIG. 1 illustrates several different models of gaming machines which may be networked to various gaming related servers. Shown is a system 100 in a gaming environment including one or more server computers 102 (e.g., slot servers of a casino) that are in communication, via a communications network, with one or more gaming machines 104A-104X (e.g., slot machines, video poker machines, bingo machines, etc.) that can implement one or more aspects of the present disclosure. In addition to gaming machines 104A-104X, the system 100 may include further gaming devices such as portable gaming devices and/or remote gaming devices. Such gaming devices may include, but are not limited to, smart phones, tablets, laptops, and game consoles. Although such gaming devices may require specialized software and/or hardware to comply with regulatory requirements regarding gaming devices used for wagering or games of chance in which monetary awards are provided. As such, such gaming devices may not be suitable for all embodiments disclosed herein.

Communication between the gaming machines 104A-104X and the server computers 102, and among the gaming machines 104A-104X, may be direct or indirect, such as over the Internet through a website maintained by a computer on a remote server or over an online data network including commercial online service providers, Internet service providers, private networks, and the like. In other embodiments, the gaming machines 104A-104X may communicate with one another and/or the server computers 102 over RF, cable TV, satellite links and the like.

In some embodiments, server computers 102 may not be necessary and/or preferred. For example, in one or more embodiments, a stand-alone gaming machines such as gaming machine 104A, gaming machine 104B or any of the other gaming machines 104C-104X can implement one or more aspects of the present disclosure. However, it is typical to find multiple gaming machines connected to networks implemented with one or more of the server computers 102 described herein.

Moreover, in some implementations, at least some of the gaming machines may be "thin-client" or "thick-client" gaming machines that are not configured for stand-alone determination of game outcomes, etc. Such client gaming machines may be configured for communication with one or more of the different server computers 102 described herein, including but not limited to the central determination gaming system server 106. Some such client gaming machines may, for example, be configured to accept tickets and/or cash (e.g., via a bill validator that also functions as a ticket reader) to load credits onto the client gaming machine, a "ticket-out" printer for outputting a credit ticket when a cash out button of a player interface is pressed, a player tracking card reader, etc. Some client gaming machines may include a transceiver for wireless communication with a player's mobile device, (e.g., for communication with a player's smartphone, tablet and/or mobile gaming device) a keypad 146, and/or an illuminated display 148 for reading, receiving, entering, and/or displaying player tracking information. A client gaming machines may include a display system, an audio system, etc., for presenting attract sequences, game presentations, etc. The game presentations may include game outcomes determined by another device, such as the central determination gaming system server 106.

The server computers 102 also may include a ticket-in-ticket-out (TITO) system server 108, a player tracking system server 110, a progressive system server 112, and/or a casino management system server 114. Gaming machines 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over a network to any of a group of remote terminals or remote gaming machines 104A-104X that utilize the game outcomes and display the results to the players.

Gaming machine 104A is often of a cabinet construction which may be aligned in rows or banks of similar devices for placement and operation on a casino floor. The gaming machine 104A often includes a main door 117 which provides access to the interior of the cabinet. Gaming machine 104A typically includes a player interface, an access channel for a bill validator 124, and/or an access channel for a ticket printer 126. The player interface may include a button area or button deck 120 accessible by a player that includes input switches or buttons 122.

In FIG. 1, gaming machine 104A is shown as a Relm XL™ model gaming machine manufactured by Aristocrat® Technologies, Inc. As shown, gaming machine 104A is a reel machine having a gaming display area 118 comprising a quantity (typically 3 or 5) of mechanical reels 130 with various symbols displayed on them. The reels 130 are independently spun and stopped to show a set of symbols within the gaming display area 127 which may be used to determine an outcome to the game.

In many configurations, the gaming machine 104A may have a main display 128 (e.g., video display monitor) mounted to, or above, the gaming display area 127. The main display 128 can be, e.g., a high-resolution LCD, plasma, LED, or OLED panel which may be flat or curved as shown, a cathode ray tube, or other conventional electronically controlled video monitor. The main display 128 may be of one or more various orientations (i.e., landscape or portrait), aspect ratios and resolutions. In some implementations, the main display 128 may include a touchscreen.

In some embodiments, the bill validator 124 may also function as a "ticket-in" reader that allows the player to use a casino-issued credit ticket to load credits onto the gaming machine 104A (e.g., in a cashless ticket ("TITO") system). In such cashless embodiments, the gaming machine 104A may also include a "ticket-out" printer 126 for outputting a credit ticket when a "cash out" button of a player interface is pressed. Cashless TITO systems may be used to generate and track unique bar-codes or other indicators printed on tickets to allow players to avoid the use of bills and coins by loading credits using a ticket reader and cashing out credits using a ticket-out printer 126 on the gaming machine 104A. The gaming machine 104A may have hardware meters for purposes including ensuring regulatory compliance and monitoring the player credit balance. In addition, there can be additional meters that record the total amount of money wagered on the gaming machine, total amount of money deposited, total amount of money withdrawn, and total amount of winnings on gaming machine 104A.

In some embodiments, a player tracking card reader 144, a transceiver for wireless communication with a player's smartphone, a keypad 146, and/or an illuminated display 148 for reading, receiving, entering, and/or displaying player tracking information is provided in the gaming machines 104A. In such embodiments, a game controller (not shown in FIG. 1) within the gaming machines 104A can communicate with the player tracking system server 110 to send and receive player tracking information.

Gaming machines 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming machine 104A and may be activated by a player (e.g., using a switch or one of buttons 122 of a player interface) to indicate to operations staff that gaming machine 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming machines 104A have traditionally also included a handle 132 typically mounted to the side of main cabinet 116 which may be used to initiate game play.

Figure 2A:
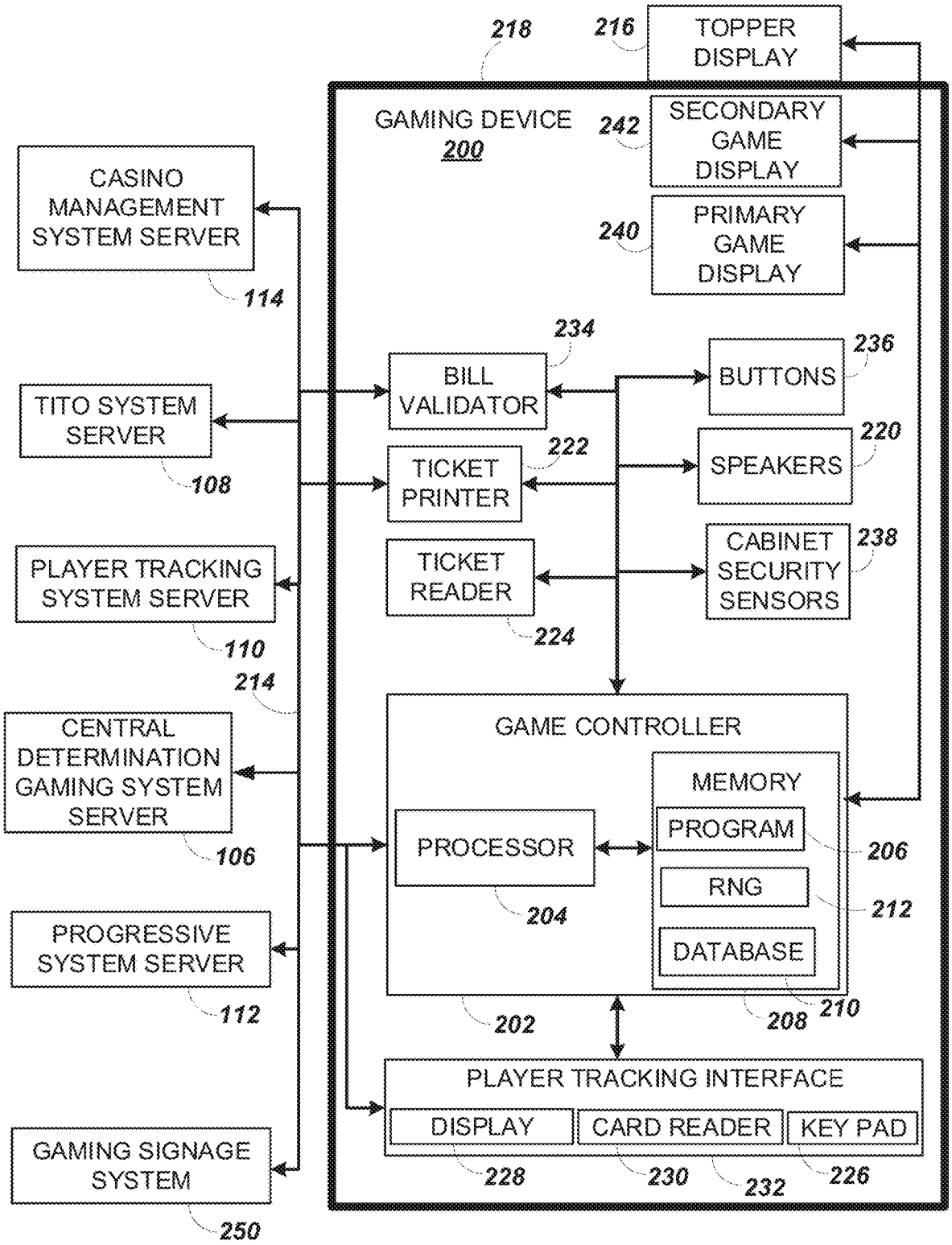
FIG. 2A is a block diagram showing various functional elements of an example gaming machine.

Many or all of the above-described components can be controlled by circuitry (e.g., a gaming controller) housed inside the main cabinet 116 of the gaming machine 104A, the details of which are shown in FIG. 2A.

Note that not all gaming machines that are suitable for implementing embodiments of the present disclosure necessarily include top wheels, top boxes, information panels, cashless ticket systems, and/or player tracking systems. Further, some suitable gaming machines may have only a single game display that includes only a mechanical set of reels and/or a video display, while others are designed for bar meters or table tops and have displays that face upwards.

An alternative example gaming machine 1048 illustrated in FIG. 1 is the Arc™ model gaming machine manufactured by Aristocrat® Technologies, Inc. Note that, where possible, reference numerals identifying similar features of the gaming machine 104A embodiment are also identified in the gaming machine 1048 embodiment using the same reference numbers. Gaming machine 104B does not include physical reels, but instead shows game play functions on main display 128. An optional topper screen 140 may be used as a secondary game display for bonus play to show game features or attraction activities while a game is not in play, or any other information or media desired by the game designer or operator. In some embodiments, topper screen 140 may also or alternatively be used to display progressive jackpot prizes available to a player during play of gaming machine 1048.

Example gaming machine 1048 includes a main cabinet 116 including a main door 117 which opens to provide access to the interior of the gaming machine 1048. The main or service door 117 is typically used by service personnel to refill the ticket-out printer 126 and collect bills and tickets inserted into the bill validator 124. The door 117 may also be accessed to reset the machine, verify and/or upgrade the software, and for general maintenance operations.

Another example gaming machine 104C shown is the Helix™ model gaming machine manufactured by Aristocrat® Technologies, Inc. Gaming machine 104C includes a main display 128A that is in a landscape orientation. Although not illustrated by the front view provided, the landscape-style main display 128A may have a curvature radius from top to bottom, or alternatively, from side to side. In some embodiments, main display 128A is a flat panel display. Main display 128A is typically used for primary game play while secondary display 1288 is typically used for a bonus game play, to show game features or attraction activities while the game is not in play or any other information or media desired by the game designer or operator. In some embodiments, example gaming machine 104C may also include speakers 142 to output various audio such as game sound, background music, etc.

Many different types of games, including mechanical slot games, video slot games, video poker, video black-jack, video pachinko, keno, bingo, and lottery, may be provided with or implemented within the depicted gaming machines 104A-104C and other similar gaming machines. Each gaming machine may also be operable to provide many different games. Games may be differentiated according to themes, sounds, graphics, type of game (e.g., slot game vs. card game vs. game with aspects of skill), denomination, quantity of paylines, maximum jackpot, progressive or non-progressive, bonus games, and may be deployed for operation in Class II or Class III, etc.

FIG. 2A is a block diagram depicting examples of internal electronic components of a gaming machine 200 connected to various external systems. All or parts of the example gaming machine 200 shown could be used to implement any one of the example gaming machines 104A-X depicted in FIG. 1. The games available for play on the gaming machine 200 are controlled by a game controller 202 that includes one or more processors 204 and a game that may be stored as game software or a program 206 in a memory 208 coupled to the processor 204. The memory 208 may include one or more mass storage devices or media that are housed within gaming machine 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (a play or round of the game) may be generated on a remote gaming machines such as the central determination gaming system server 106 (not shown in FIG. 2A but shown in FIG. 1). The game instance may be communicated to gaming machine 200 via the network 214 and then displayed on gaming machine 200. Gaming machine 200 may execute game software, such as, but not limited to, video streaming software that allows the game to be displayed on gaming machine 200. When a game is stored on gaming machine 200, it may be loaded from the memory 208 (e.g., from a read only memory (ROM)) or from the central determination gaming system server 106 to memory 208. The memory 208 may include random access memory (RAM), ROM or another form of storage media that stores instructions for execution by the processor 204.

The gaming machine 200 may include a topper display 216 or another form of a top box (e.g., a topper wheel, a topper screen, etc.) which sits above main cabinet 218. The cabinet 218 or topper display 216 may also house a number of other components which may be used to add features to a game being played on gaming machine 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), and a card reader 230 for receiving data and/or communicating information to and from media or a device such as a smart phone enabling player tracking. Ticket printer 222 may be used to print tickets for a TITO system server 108. The gaming machine 200 may further include a bill validator 234, buttons 236 of a player interface, cabinet security sensors 238 to detect unauthorized opening of the cabinet 218, a primary game display 240, and a secondary game display 242, each coupled to and operable under the control of game controller 202.

Gaming machine 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Some gaming machines, such as gaming machines 104A-104X, are highly regulated to ensure fairness and, in many cases, gaming machines 104A-104X, 200 are operable to award monetary awards (e.g., typically dispensed in the form of a redeemable voucher). Therefore, to satisfy security and regulatory requirements in a gaming environment, hardware and software architectures are implemented in gaming machines 104A-104X, 200 that differ significantly from those of general-purpose computers. Adapting general purpose computers to function as gaming machines 200 is not simple or straightforward because of: 1) the regulatory requirements for gaming machine 200, 2) the harsh environment in which gaming machines 200 operate, 3) security requirements, 4) fault tolerance requirements, and 5) the requirement for additional special purpose componentry enabling functionality of a gaming machine. These differences require substantial engineering effort with respect to game design implementation, hardware components and software.

When a player wishes to play the gaming machine 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player can view the game outcome on the primary game display 240 and/or the secondary game display 242. Other game and prize information may also be displayed.

For each game instance, a player may make selections, which may affect play of the game. For example, the player may vary the total amount wagered by selecting the amount bet per line and the quantity of lines played. In many games, the player is asked to initiate or select options during course of game play (such as spinning a wheel to begin a bonus round or select various items during a feature game). The player may make these selections using a player interface, which may include the player input buttons 236, the primary game display 240 (which may include a touch screen), or some other device which enables a player to input information into the gaming machine 200.

During certain game events, the gaming machine 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming machine 200 or from lights behind the information panel 152 (FIG. 1).

In this example, the gaming machine 200 is also configured for communication with a gaming signage system 250 via the network 214. Various examples of gaming signage systems 250 are provided herein. According to some examples, the gaming signage system 250 may be configured for communication with other elements of a gaming system via the network 214, such as the central determination gaming system server 106, the progressive system server 112, the player tracking system server 110 the casino management system server 114 and/or the TITO system server 108.

When the player is done, he/she cashes out the credit balance. For example, the player may press a cash-out button of a player interface to receive a payout from a credit payout mechanism such as ticket printer 222, player tracker interface 232, or coin hopper. The ticket printer 222 may provide a ticket, which may be redeemed for money or inserted into another machine to establish a credit balance for play. In other embodiments, the credit balance may be disperse via a coin hopper or transferred to a card or account via player tracker interface 232.

While an example gaming machine 200 has been described in regard to FIG. 2A, certain aspects of the present disclosure may be implemented by gaming machines that lack one or more of the above-described components. For example, not all gaming machines suitable for implementing aspects of the present disclosure necessarily include top boxes, information panels, cashless ticket systems, and/or player tracking systems. Further, some suitable gaming machines may include a single game display having mechanical reels or a video display. Moreover, other embodiments may be designed for bar tables and have displays that face upwards.

Many different types of wagering games, including mechanical slot games, video slot games, video poker, video black-jack, video pachinko, keno, bingo, and lottery, may be provided by the gaming machine 200. In particular, the gaming machine 200 may be operable to provide many different instances of games of chance. The instances may be differentiated according to themes, sounds, graphics, type of game (e.g., slot game vs. card game vs. game with aspects of skill), denomination, quantity of paylines, maximum jackpot, progressive or non-progressive, bonus games, class 2 or class 3, etc.

The gaming machine 200 may allow a player to select a game of chance, skill, or combination thereof, to play from a plurality of instances available on the gaming machine 200. For example, the gaming machine 200 may provide a menu with a list of the instances of games that are available for play on the gaming machine 200 and a player may be able to select, from the list, a game that they wish to play.

Figure 2B:
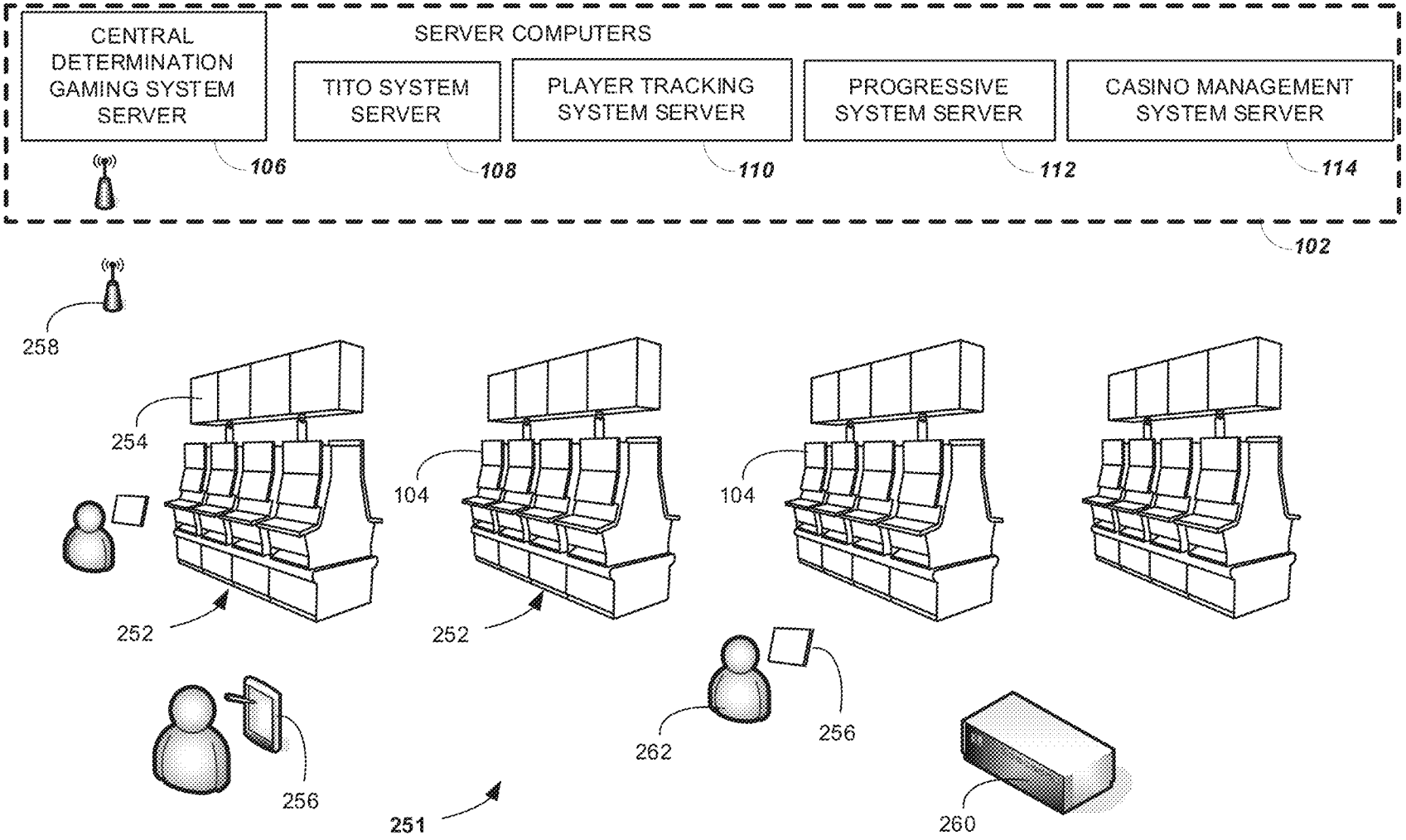
FIG. 2B depicts a casino gaming environment according to one example.

FIG. 2B depicts a casino gaming environment according to one example. In this example, the casino 251 includes banks 252 of gaming machines 104. In this example, each bank 252 of gaming machines 104 includes a corresponding gaming signage system 254. According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the gaming machines 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a player interface of a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
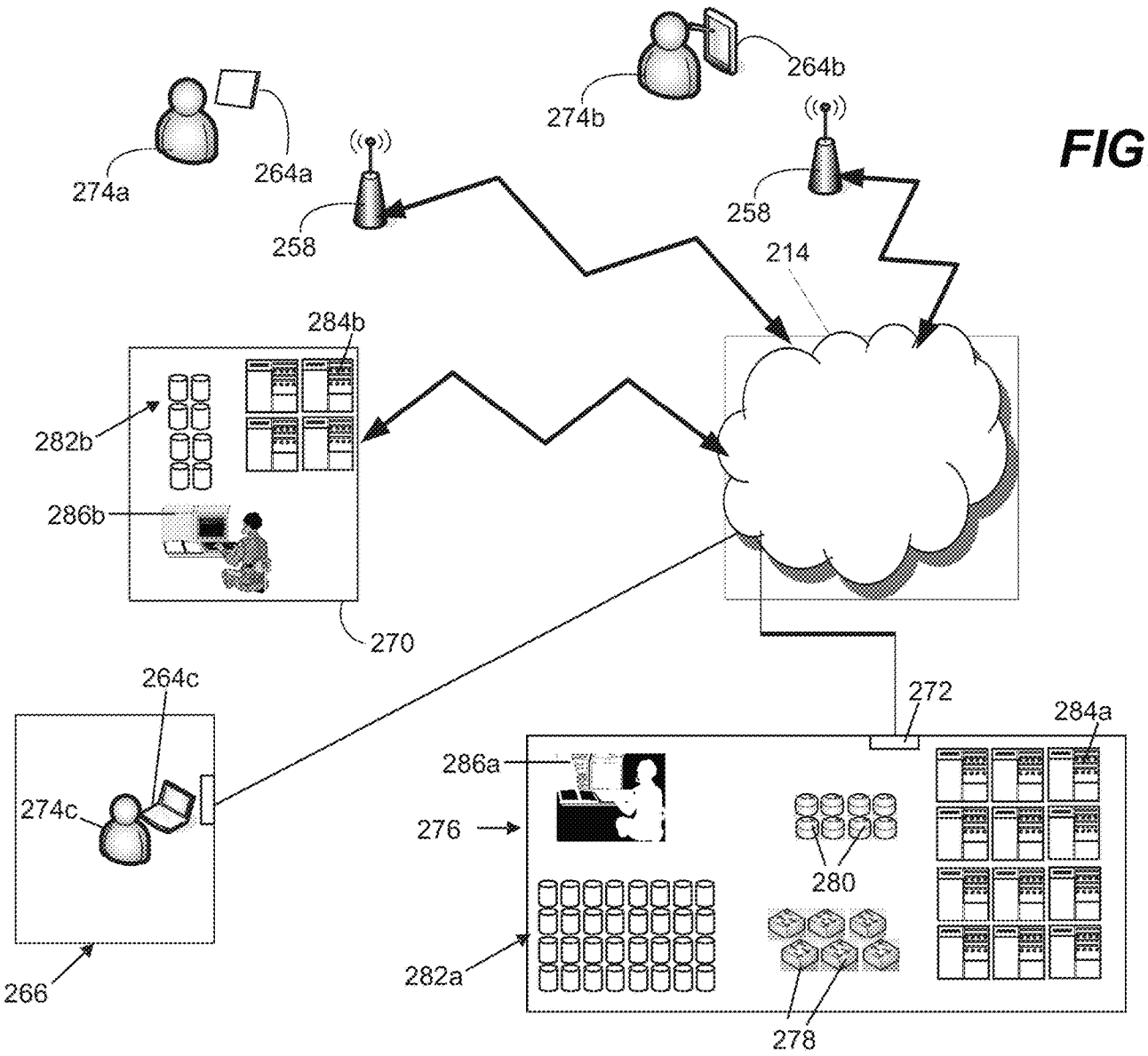
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the quantities, types and arrangements of gaming machines shown in FIG. 2C are merely shown by way of example. In this example, various gaming machines, including but not limited to end user devices (EUDs) 264*a*, 264*b* and 264*c* are capable of communication via one or more networks 214. The networks 214 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 214. The gaming data center 276 is capable of communication with the networks 214 via the gateway 272. In this example, switches 278 and routers 280 are configured to provide network connectivity for devices of the gaming data center 276, including storage devices 282*a*, servers 284*a* and one or more workstations 286*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 214. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 214. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3A:
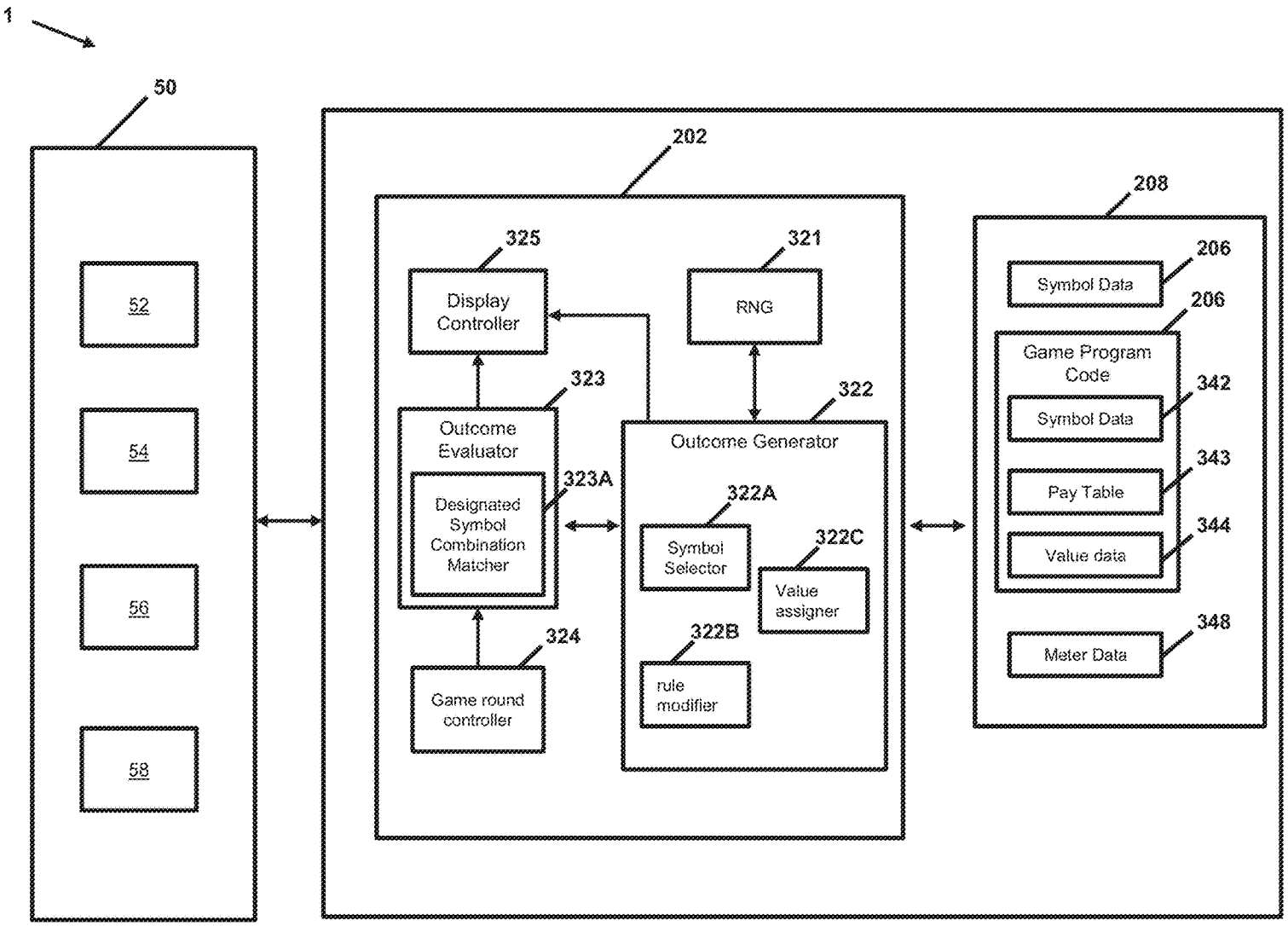
FIG. 3A is a further block diagram showing various functional elements of an embodiment of the game controller of FIG. 2A.

In FIG. 3A, the processor 204 of game controller 202 of gaming machine 200 is shown implementing a number of modules based on game program code 206 stored in memory 208. Persons skilled in the art will appreciate that several of the modules could be implemented in some other way, for example, by a dedicated circuit. The game controller 202 is an example of what may be referred to herein as a "control system." In some implementations, the control system also may include the memory 208. Other examples of control systems are disclosed herein.

According to this example, these modules include an outcome generator 322 which operates in response to the player's operation of player input buttons 236 of a player interface to place a wager and initiate a play of the game and generates a game outcome which will then be evaluated by outcome evaluator 323. In some examples, the first part of forming the game outcome may be for a symbol selector 322A to select symbols from a set of symbols specified by symbol data 342 using a random number generator 321. The selected symbols may be advised to the display controller 325, which causes them to be displayed as a symbol display on primary game display 240 at a set of display positions.

In certain embodiments, the symbol data 342 includes one or more virtual reels that correspond to one or more reels displayed by the primary game display 240. The virtual reels may include an arrangement of symbols selected from symbol data 342 in, for example, a predetermined or random manner. The symbol selector 322A may select a stop position for the one or more virtual reels based on one or more outcomes of the random number generator 321. The stop position of the one or more reels then determines the symbols that are selected on the primary game display 240. In some alternative implementations, the functionality of one or more of the modules shown in FIG. 3A may be implemented in another device, e.g., in a server. For example, the functionality of the RNG 321, the outcome generator 322, the outcome evaluator 323 and/or the game round controller 324 may be implemented in a device that is configured for communication with the gaming machine 200.

In the embodiment described below, the display positions of the symbol display are arranged in a rectangular matrix comprising a plurality of columns and a plurality of rows. However, other arrangements known in the gaming industry could be employed in embodiments of the disclosure. For example, in some arrangements, there are more symbols in some columns than in others, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighboring reel.

Figure 3B:
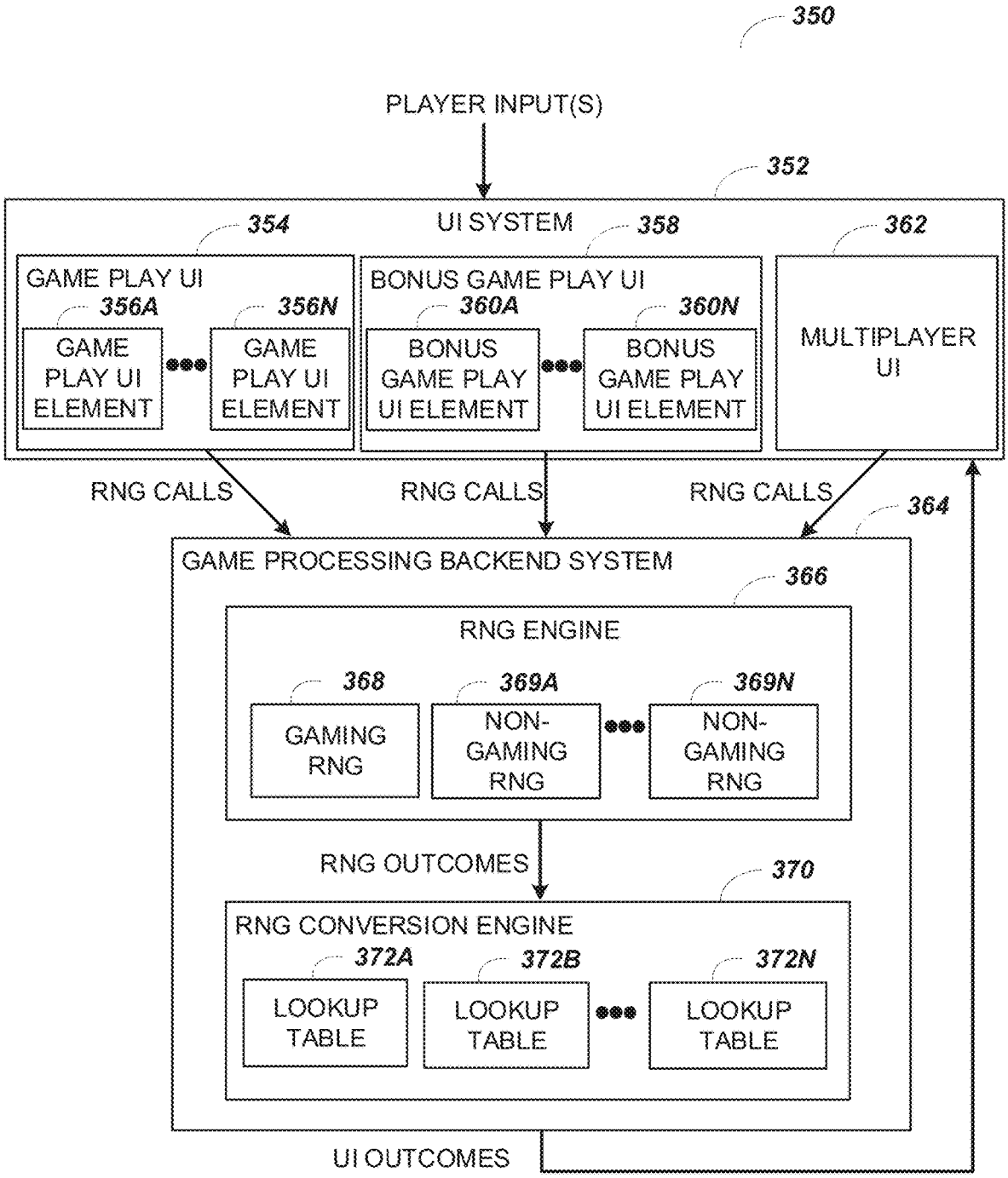
FIG. 3B illustrates, in block diagram form, an embodiment of a game processing architecture algorithm that implements a game processing pipeline for the play of a game in accordance with various embodiments described herein.

FIG. 3B illustrates, in block diagram form, an embodiment of a game processing architecture 350 that implements a game processing pipeline for the play of a game in accordance with various embodiments described herein. As shown in FIG. 3B, the gaming processing pipeline starts with having a UI system 352 receive one or more player inputs for the game instance. Based on the player input(s), the UI system 352 generates and sends one or more RNG calls to a game processing backend system 364. Game processing backend system 364 then processes the RNG calls with RNG engine 366 to generate one or more RNG outcomes. The RNG outcomes are then sent to the RNG conversion engine 370 to generate one or more game outcomes for the UI system 352 to display to a player. The game processing architecture 350 can implement the game processing pipeline using a gaming machine, such as gaming machines 104A-104X and 200 shown in FIGS. 1 and 2, respectively. Alternatively, portions of the gaming processing architecture 350 can implement the game processing pipeline using a gaming machine and one or more remote gaming machines, such as central determination gaming system server 106 shown in FIG. 1.

The UI system 352 includes one or more UIs that a player can interact with. The UI system 352 could include one or more game play UIs 354, one or more bonus game play UIs 358, and one or more multiplayer UIs 362, where each UI type includes one or more mechanical UIs and/or graphical UIs (GUIs). In other words, game play UI 354, bonus game play UI 358, and the multiplayer UI 362 may utilize a variety of UI elements, such as mechanical UI elements (e.g., physical "spin" button or mechanical reels) and/or GUI elements (e.g., virtual reels shown on a video display or a virtual button deck) to provide a player interface that receives player inputs and/or presents game play to a player. Using FIG. 3B as an example, the different UI elements are shown as game play UI elements 356A-356N and bonus game play UI elements 360A-360N.

The game play UI 354 represents a UI that a player typically interfaces with for a base game. During a game instance of a base game, the game play UI elements 356A-356N (e.g., GUI elements depicting one or more virtual reels) are shown and/or made available to a user. In a subsequent game instance, the UI system 352 could transition out of the base game to one or more bonus games. The bonus game play UI 358 represents a UI that utilizes bonus game play UI elements 360A-360N for a player to interact with and/or view during a bonus game. In one or more embodiments, at least some of the game play UI element 356A-356N are similar to the bonus game play UI elements 360A-360N. In other embodiments, the game play UI element 356A-356N can differ from the bonus game play UI elements 360A-360N.

FIG. 3B also illustrates that UI system 352 could include a multiplayer UI 362 purposed for game play that differs or is separate from the typical base game. For example, multiplayer UI 362 could be set up to receive player inputs and/or presents game play information relating to a tournament mode. When a gaming machine transitions from a primary game mode that presents the base game to a tournament mode, a single gaming machine is linked and synchronized to other gaming machines to generate a tournament outcome. For example, multiple RNG engines 366 corresponding to each gaming machine could be collectively linked to determine a tournament outcome. To enhance a player's gaming experience, tournament mode can modify and synchronize sound, music, reel spin speed, and/or other operations of the gaming machines according to the tournament game play. After tournament game play ends, operators can switch back the gaming machine from tournament mode to a primary game mode to present the base game. Although FIG. 3B does not explicitly depict that multiplayer UI 362 includes UI elements, multiplayer UI 362 could also include one or more multiplayer UI elements.

Based on the player inputs, the UI system 352 could generate RNG calls to a game processing backend system 364. As an example, the UI system 352 could use one or more application programming interfaces (APIs) to generate the RNG calls. To process the RNG calls, the RNG engine 366 could utilize gaming RNG 368 and/or non-gaming RNGs 369A-369N. Gaming RNG 368 corresponds to RNG 212 shown in FIG. 2. As previously discussed with reference to FIG. 2, gaming RNG 368 often performs specialized and non-generic operations that comply with regulatory and/or game requirements. For example, because of regulation requirements, gaming RNG 368 could be a cryptographic random or pseudorandom number generator (PRNG) (e.g., Fortuna PRNG) that securely produces random numbers for one or more game features. To generate random numbers, gaming RNG 368 could collect random data from various sources of entropy, such as from an operating system (OS) and/or a hardware based RNG (not showing in FIG. 3B). Alternatively, non-gaming RNGs 369A-369N may not be cryptographically secure and/or be computationally less expensive. Non-gaming RNGS 369A-369N can, thus, be used to generate outcomes for non-gaming purposes. As an example, non-gaming RNGs 369A-369N can generate random numbers for such as generating random messages that appear on the gaming machine.

The RNG conversion engine 370 processes each RNG outcome from RNG engine 366 and converts the RNG outcome to a UI outcome that is feedback to the UI system 352. With reference to FIG. 2, RNG conversion engine 370 corresponds to RNG conversion engine 212 used for game play. As previously described, RNG conversion engine 370 translates the RNG outcome from the RNG 212 to a game outcome presented to a player. RNG conversion engine 370 utilizes one or more lookup tables 372A-372N to regulate a prize payout amount for each RNG outcome and how often the gaming machine pays out the derived prize payout amounts. In one example, the RNG conversion engine 370 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game. In various embodiments, RNG 212 could be a physical device such as a co-processor with memory that executes instructions to generate random numbers. In certain embodiments, RNG 212 could be implemented in processor 204.

After generating the UI outcome, the game processing backend system 364 sends the UI outcome to the UI system 352. Examples of UI outcomes are symbols to display on a video reel or reel stops for a mechanical reel. In one example, if the UI outcome is for a base game, the UI system 352 updates one or more game play UI elements 356A-356N, such as symbols, for the game play UI 354. In another example, if the UI outcome is for a bonus game, the UI system could update one or more bonus game play UI elements 360A-360N (e.g., symbols) for the bonus game play UI 358. In response to updating the appropriate UI, the player may subsequently provide additional player inputs to initiate a subsequent game instance that progresses through the game processing pipeline.

Hold and Spin Game

Figure 4:
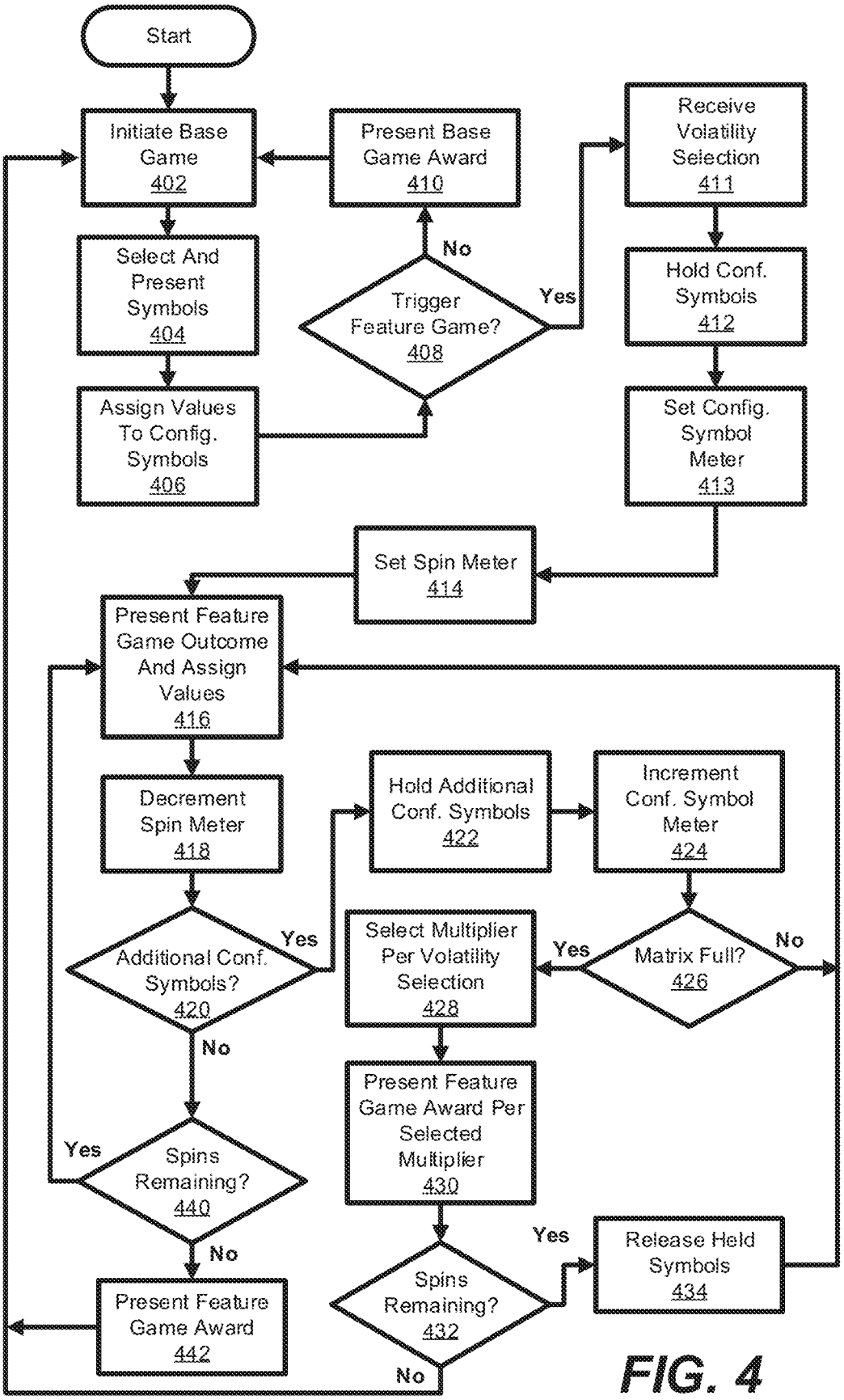
FIG. 4 provides a flowchart depicting operation of a gaming machine in accordance with a base game and a feature game of the present disclosure.

FIG. 4 provides a flowchart depicting operation of one embodiment of a gaming machine 200. Per the flowchart of FIG. 4, the gaming machine may provide a base game and a hold and spin game. To simply the following discussion, the gaming machine 200 provides an initial quantity of spins to the hold and spin game. However, other terms such as games, rounds, instances, etc. may be more appropriate than the term spin for other feature games. Thus, references to spins should be interpreted to include games, rounds, instances, etc. with respect to these other feature games. Moreover, while the following describes the hold and spin game as a feature game whose play is triggered or initiated based on play of a base game, the hold and spin game or aspects thereof may be part of another game such as a base game, free game, etc. and/or may be initiated without regard to play of a base game.

As shown, the gaming machine 200 at 402 may initiate play of the base game in response to game controller 202 receiving input from a player interface of the gaming machine 200. In response to initiating play of the base game, a symbol selector 322A (see, e.g., FIG. 3A) of the gaming machine 200 at 404 may select a plurality of symbols from a set of symbols and the gaming machine 200 may display the selected plurality of symbols as a base game outcome at the respective display positions arranged on primary game display 240. The set of symbols may be stored as symbol data 342 in memory 208 and may include both configurable symbols and non-configurable symbols.

In an embodiment, the configurable symbols each comprise at least a common component and at least a variable component. The variable component may indicate a value of a prize that is associated with each of the configurable symbols. An example of a configurable symbol is shown in FIGS. 6A-6E in the form of a pearl symbol 602. In such embodiment, the common component is the pearl symbol 602 itself, while the variable component is the indicia 604 overlaying pearl symbol 602. In this case, indicia are numerals directly indicative of the numeric value of the prize. In other embodiments, the indicia may indirectly indicate the numeric value of the prize. In some embodiments, variable component may be displayed on the common component prior to, during, or after the spinning of the reels.

In some embodiments, at least one value of the respective prizes is generated by randomly selecting one of a plurality of defined multipliers that is applied to an amount wagered on the base game from which the feature is game triggered. To this end, value assigner 322C in some such embodiments selects the predefined multipliers from value data 344 using a value obtained from the random number generator (RNG) 321, applies the multiplier to the initial wager to obtain a prize value, and assigns the prize value to each of the configurable symbols selected by symbol selector 322A. The plurality of defined multipliers in some such embodiments may be selected at random according to a weighted probability based at least in part on the amount wagered on the base game. That is, the value assigner 322C may obtain a value from RNG 321 and may use this value to determine from the weighted table which value to assign to a configurable symbol. In an embodiment, the assignment of values to the configurable symbols is performed by the value assigner 322C after the symbols have been selected and the game controller knows they will be displayed but before they are displayed on the display. In another embodiment, the assignment occurs after the symbols have been displayed on display 240. In another embodiment, values are assigned to all configurable symbols irrespective of whether they will be displayed. In this manner, the value assigner 322C may scale the values assigned to the configurable symbols based on the wager.

At 408, the outcome evaluator 323 of the game controller 202 may monitor play of the base game and determine whether a trigger event has occurred. In this embodiment, a trigger event occurs when the base game outcome includes a predetermined quantity, e.g., six, of configurable symbols on the primary game display 240. If a trigger event has not occurred, the game controller at 410 may determine and present awards for any winning symbol combinations in the base game outcome and returns to 402 for further plays of the base game. However, if a trigger event does occur, the game controller 202 at 411 may initiate a feature game by presenting via display 240 volatility options 540*a*-540*c* of FIG. 5 for the feature game and receiving a volatility selection that selects one of the volatility options. In one embodiment, the each volatility option defines an initial quantity of spins for the feature game. For example, a medium or normal volatility option may provide the feature game with a normal or baseline quantity of spins (e.g., sixty (60) spins), a low volatility option may provide the feature game with a greater quantity of spins (e.g., one hundred and twenty (120) spins), a high volatility option may provide the feature game with a lower quantity of spins (e.g., twelve (12) spins). In various embodiments, in additional to the initial quantity of spins, each volatility options may also be associated with one or more additional control variables. One such control variable may be a range of award amounts associated with the configurable symbols. Another control variable may be a multiplier that is applied to one or more configurable symbol values during or after the play of the feature game.

As shown at 412, the game controller 202 may hold each configurable symbol in the base game outcome at its respective display position $\mathbf{524}_1$-$\mathbf{524}_{15}$. See, e.g., FIG. 5. The game controller 202 at 413 may set the configurable symbol meter 510 of FIG. 5 to the quantity of configurable symbols that are held on reels $\mathbf{514}_1$-$\mathbf{514}_{15}$. In some embodiments, the quantity of configurable symbols held on reels $\mathbf{514}_1$-$\mathbf{514}_{15}$ is also the quantity of configurable symbols which originally triggered the feature game. That is, in some such embodiments, the configurable symbol meter 510 is initially set to six (6), as six (6) configurable symbols trigger the feature game. Alternatively, for example, if the base game outcome includes seven (7) configurable symbols, but only six (6) are required for triggering the feature game, the game controller 202 may initially set the configurable symbol meter 510 to seven (7) (i.e., equal to the quantity of configurable symbols in the base game outcome).

In addition to setting the configurable symbol meter 510, the gaming machine 200 at 414 may set a spin meter 512 to the initial quantity of games specified by the selected volatility option 540*a*-540*c*. For example, in an embodiment, if the low volatility option 540*a* is selected, game controller 202 may set the spin meter 512 to sixty (60). Similarly, if the high volatility option 540*c* is selected, the game controller 202 may set the spin meter 512 to twelve (12). In other embodiments, the volatility options may specify different initial spin quantities than those presented above. For example, in some embodiments, the volatility options may specify initial quantities between one (1) and one hundred and twenty (120) and the game controller 202 may accordingly set the spin meter 512 to values between one (1) and one hundred and twenty (120) based on the selective volatility option.

At 416, the outcome generator 322 of the game controller 202 may present a feature game outcome on display 240. Similar to the base game, the symbol selector 322A may select symbols from symbol data and cause the selected symbols to be displayed at display positions $\mathbf{524}_1$-$\mathbf{524}_{15}$ that do not already display a configurable symbol. Note that in certain embodiments, the symbol selector 322A may select symbols for the feature game outcome from a full set of available symbols (e.g., the full set of symbols defined by symbol data 342) including any configurable symbols. In other embodiments, the symbol selector 322A may select the symbols for the feature game outcome from a reduced set of symbols that take into account any configurable symbols already held. For example, in one or more embodiments, only configurable symbols and blank symbols may be available for selection. In other words, the reel strips for the feature game may contain only configurable symbols and blank symbols (e.g., positions without any symbol). In an alternative embodiment, the symbols may be selected for the feature game from an increased set of symbols. For example, symbols may be purchased or otherwise added to one or more the reel strips prior to initiating the feature game or spin of the feature game. If one or more configurable symbols are selected, in this example, the value assigner 322C of the game controller 202 may assign randomly selected values to each configurable symbol at 416. The values assigned to the configurable symbols may be different based on the different volatility options. For example, the low volatility option (having a higher initial spin quantity) may be associated with lower values for the configurable symbols while the high volatility option (having a lower initial spin quantity) may be associated with higher values for the configurable symbols. In various embodiments, each volatility option may be associated with a set of values that may be used to determine the value of the configurable symbols. Theses sets of values may be stored as one or more weighted tables from which a particular value may be selected based on an outcome of a random number determination.

After presenting the feature game outcome, the game controller 202 at 418 may decrement the spin meter 512 by a defined amount, such as one (1). In some embodiments, the game controller 202 may decrement the spin meter 512 by the defined amount (e.g., one (1)), regardless of whether a configurable symbol is displayed.

The outcome evaluator 323 at 420 may monitor play of the feature game and determine whether the symbol selector 322A selected an additional configurable symbol at 416 for the feature game outcome. If the outcome evaluator 323 determines that at least one additional configurable symbol was selected by the symbol selector 322A and added to the feature game outcome, then the game controller 202 at 422 may hold each of the additional configurable symbols at their respective display positions $\mathbf{524}_1$-$\mathbf{524}_{15}$. Furthermore, the game controller 202 at 424 may increment the configurable symbol meter 510 to reflect the total quantity of configurable symbols in the feature game outcome.

At 426, the outcome evaluator 323 may determine whether game controller 202 has filled the matrix display positions $524_1$-$524_{15}$ with configurable symbols by determining whether each of the display positions $524_1$-$524_{15}$ includes a configurable symbol. If the outcome evaluator 323 determines that the game controller 202 has not filled the matrix of display the matrix of display positions $524_1$-$524_{15}$ with configurable symbols, the game controller 202 may return to 416 to conduct another spin of the feature game. However, if the outcome evaluator 323 determines that the game controller 202 has filled the matrix of display positions $524_1$-$524_{15}$ with configurable symbols, the game controller 202 may present an award, via the display 240, that is based on the indicia depicted by the configurable symbols. To this end, the game controller 202 at 428 may select a multiplier M per the selected volatility option 540*a*-540*c*. In one embodiment, the game controller 202 selects the multiplier M such that game controller 202 provides the same expected payout or the same return-to-player regardless of which volatility option 540*a*-540*c* was received at 411. Details regarding how the game controller 202 selects the multiplier M so as to achieve the desired, same return-to-player across the volatility options 540*a*-540*c* are presented below.

The game controller 202 at 430 may present the award per the selected multiplier M. In one embodiment, the game controller 202 presents the award by stepping through each display position $524_1$-$524_{15}$ of the matrix and adding the value of its respective configurable symbol to win meter 508 of FIG. 5. Moreover, the game controller 202 may repeat such stepping through the display positions $524_1$-$524_{15}$ a number of times equal to the multiplier M. In other embodiments, the game controller 202 may step through the display positions $524_1$-$524_{15}$ to obtain an initial sum and then multiply the initial sum by the selected multiplier M to arrive at the award. Other manners of presenting the award are contemplated and may be encompassed by the appended claims.

At 432, the game controller 202 may determine whether the feature game has any spins remaining. If game controller 202 determines that spins remain (e.g., spin meter 512 not equal to zero), the game controller 202 at 434 may release the held configurable symbols and return to 416 in order to conduct another spin of the feature game. As a result of releasing the held configurable symbols, such a spin at 416 updates all display positions $524_1$-$524_{15}$ with newly selected symbols. On the other hand, if the game controller 202 determines that no spins remain, (e.g., the spin meter 512 reaches zero), the game controller 202 may end the feature game and return to 402 for further plays of the base game.

Referring back to 420, if the outcome evaluator 323 determines that at least one additional configurable symbol was not selected by the symbol selector 322A and added to the feature game outcome, then the game controller 202 proceed to 440. At 440, the game controller 202 may determine whether if any spins for the feature game remain. If spins remain, the game controller 202 may return to 416 in order to spin the reels and present an updated feature game outcome. If no respins remain, the game controller 202 at 440 may determine to end the feature game. In response to ending the feature game, the game controller 202 at 442 may present, via display 240, any remaining awards. In one embodiment, the game controller 202 presents the award by stepping through each display position $524_1$-$524_{15}$ of the matrix and adding the value of its respective configurable symbol to the win meter 508. After presenting the award, the game controller 202 may return to 402 for further plays of the base game.

In some embodiments, the base game may not present configurable symbols. In such embodiments, a feature game may be awarded in response to other triggering conditions. For example, in some embodiments, after a feature game is triggered, the game controller 202 may initiate a feature game using different reels than those used in the base game. In such embodiments, the feature game may trigger a hold and spin game in response to the feature game presenting a threshold quantity of configurable symbols in the manner described above. In some embodiments, the hold and spin game may be triggered randomly or in response to certain symbol combinations achieved in the base game or another feature game. In some embodiments, the number of symbol positions in the feature game may be more than the symbol display positions in the base game.

Figure 5:
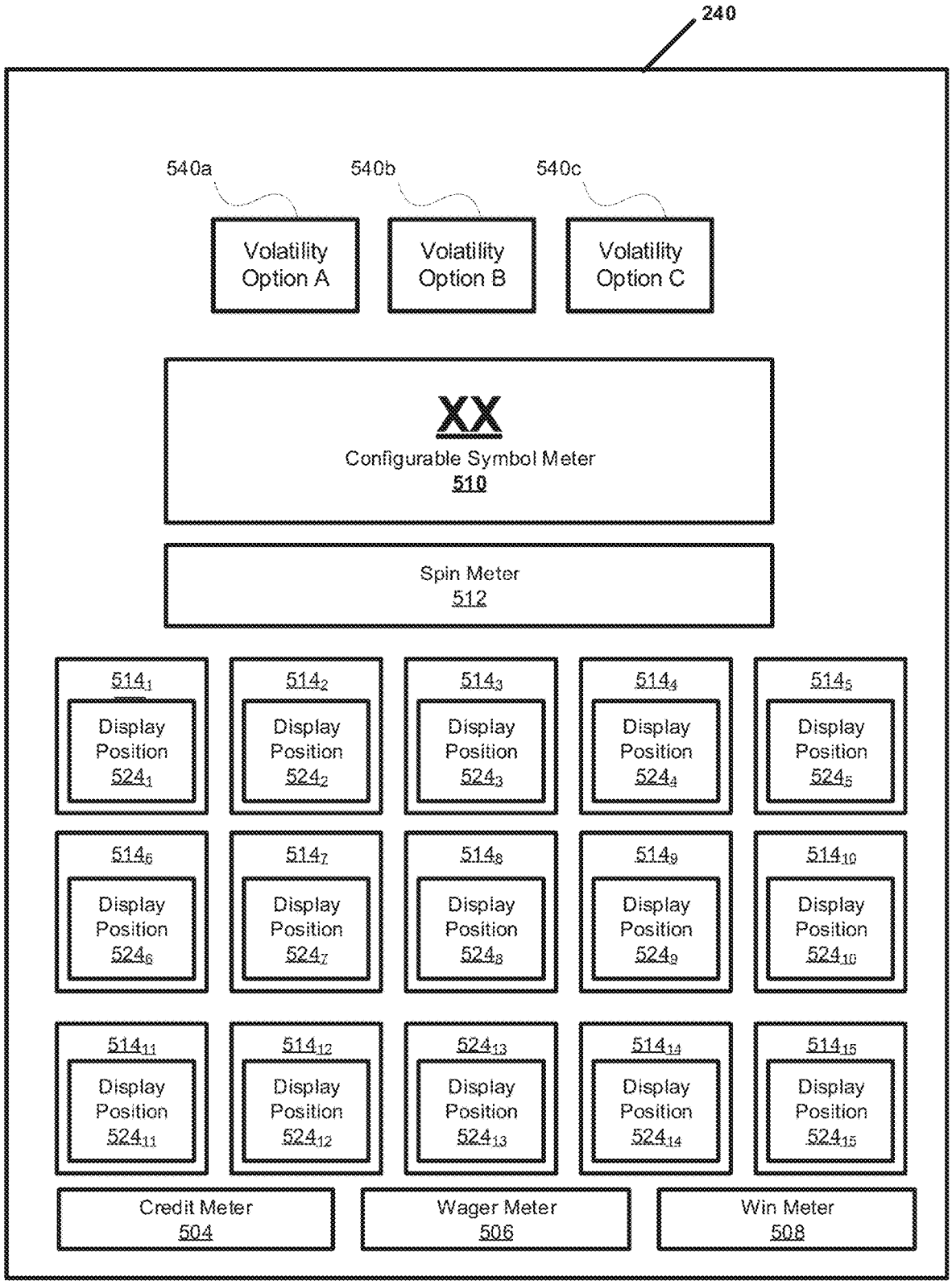
FIG. 5 provides an example display screen of the feature game of FIG. 4.

In some embodiments, the display 240 may associate individual reels with each of the display positions. For example, as shown in FIG. 5, if there are fifteen (15) display positions $524_1$-$524_{15}$, the display 240 may present fifteen separate reels $514_1$-$514_{15}$, one for each of the fifteen (15) display positions $524_1$-$524_{15}$. Each of the reels $514_1$-$514_{15}$ may include a mixture of non-configurable symbols and configurable symbols. Before the hold and spin game, the game controller 202 in some examples may set the configurable symbol meter 510 to zero and hold none of the configurable symbols 602 that triggered the hold and spin game. In such an embodiment, symbol selector 322A for the first spin of the hold and spin game selects reel stop positions for all of the reels $514_1$-$514_{15}$. If any of the reels $514_1$-$514_{15}$ are stopped with a configurable symbol in place, that configurable symbol may be held in position by holding/locking the respective reel $514_1$-$514_{15}$ (i.e., not spinning the held/locked reels in a subsequent game). That is, in subsequent spins according to this example, only the reels $514_1$-$514_{15}$ corresponding to symbol positions where a configurable symbol has not been displayed are spun.

Example Plays of Hold and Spin Game

More specific examples of embodiments of the present disclosure are now described with reference to FIGS. 5 and 6A-6E. In general, examples of FIGS. 6A-6E provide a hold and spin feature that utilizes a 3×5 matrix of display positions $524_1$-$524_{15}$ as shown in FIG. 5.

In the embodiment of FIGS. 6A-6E, the hold and spin feature is triggered when a base game outcome includes at least six (6) configurable symbols, which are shown as pearl symbols 602 in FIGS. 6A-6E. Thus, the base game outcome of FIG. 6A triggers the hold and spin feature because the base game outcome includes six (6) pearl symbols 602. In particular, the base game outcome includes a pearl symbol 602 at each display position of column 1 (i.e., display positions $524_1$, $524_6$, $524_{11}$), the top two display positions of column 2 (i.e., display positions $524_2$, $524_7$), and the top display position of column 5 (i.e., display position $524_5$).

At this point, the game controller 202 may set the configurable symbol meter 510 to six (6) to reflect the quantity of displayed and held pearl symbols 602. Moreover, in one embodiment, the game controller 202 is guaranteed to present an award for the hold and spin game that includes at least the accumulated value indicated by the indicia 604 of the six pearl symbols 602. That is, even before play of hold and spin starts, the pearl symbols 602 of FIG. 6A, which triggered the hold and spin feature, provide an award of 3,600 credits (i.e., the accumulated sum of the indicia 604).

After triggering the hold and spin feature, the game controller 202 may await a volatility selection before proceeding with the hold and spin feature. In particular, the game controller 202 may present several volatility options

Figures 6A, 6B, 6C:
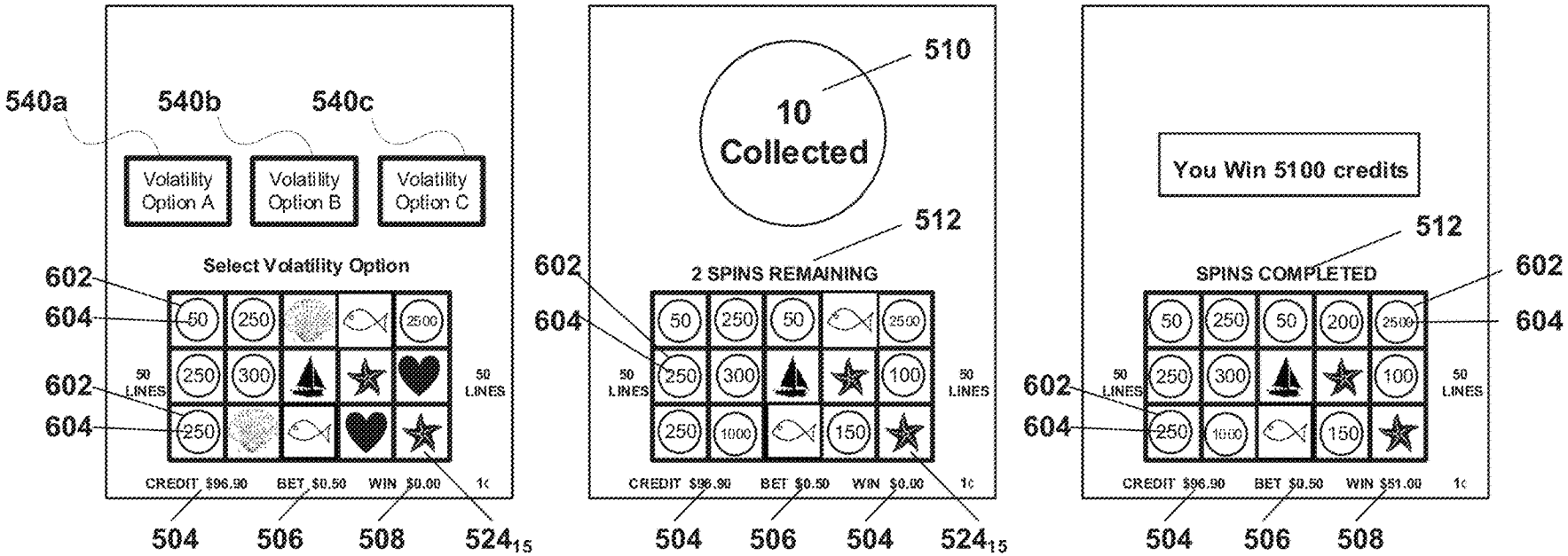
FIGS. 6A to 6E present a series of display screens depicting operation of the gaming machine per the process of FIG. 4.

540*a*-540*c* via the player interface. For example, the game controller 202 may present the volatility options via the display 240 (as shown in FIG. 6A) and/or player input buttons 236. The game controller 202 may receive a volatility selection that selects one of the volatility options 540*a*-540*c* in response to the player actuating a touchscreen of the display 240 or player input buttons 236 of the player interface. In some embodiments, the game controller 202 waits indefinitely for the player to make their volatility selection. In other embodiments, the game controller 202 waits a predefined period of time for the volatility selection before automatically selecting one or the volatility options 540*a*-540*c* and initiating the hold and spin game. For example, the game controller 202 may (i) randomly select one of the volatility options 540*a*-540*c*, (ii) use a predefined default volatility option of the volatility options 540*a*-540*c*, or (iii) select one of the volatility options 540*a*-540*c* via other criteria upon expiration of the predefined period of time. Regardless of whether the player or the game controller 202 selects a volatility option 540*a*-540*c*, the game controller 202 proceeds with conducting the hold and spin feature per the selected volatility option 540*a*-540*c*.

In the example of FIGS. 6A-6E, it is assumed that the player selected a volatility option from volatility options 540*a*-540*c* that specifies an initial quantity of three (3) spins and a multiplier M of two (2). In this example, the volatility selection may be influenced by the values of the six pearl symbols displayed 604. For example, if the values displayed are relatively low, a player may be influenced to select an option that includes a higher number of spins and alternatively, if the values are relatively high, the player may be influenced to select an option that includes a lower number of spins, or vice versa. Absent countering measures, the player via the volatility option selected may influence the RTP (return to player) of the game. Therefore, various aspects of the disclosure address the technical problem of implementing a volatility selection game, while maintaining the same RTP or a desired range of RTP across the various selections.

In one or more aspects of the disclosure, the technical problem can be addressed by hiding the values associated with the configurable symbols until after a volatility selection is received from the player. More specifically, values associated with the configurable symbols, such as the pearl symbols, are not displayed until the player has made a volatility selection choice. Additionally, the values may be determined based on the player volatility selection. For example, if a player selects a first volatility option, then the values may be determined from a first set of value, whereas if the player selected a second volatility option, then the values would have been selected from a second set of values. The different sets of values are selected to correspond to their respective volatility option. After the values have been determined, the values may be revealed.

According to further aspects of the disclosure, the technical problem may be addressed by adjusting one or more factors which counteract factors of the selected volatility options. For example, if the volatility option permits a player to select from a range range of an initial quantity of spins (a first factor), then a multiplier value (a second factor) may be adjusted to counteract the player selected variance in the initial quantity of spins. In particular, the gaming machine may provide a larger multiplier value for a selection providing fewer initial spins than a selection providing a more initial spins.

FIG. 6B depicts the hold and spin feature after the player has made a volatility selection and the game controller 202 has spun the reels $\mathbf{514}_3$, $\mathbf{514}_4$, $\mathbf{514}_8$, $\mathbf{514}_9$, $\mathbf{514}_{10}$, $\mathbf{514}_{12}$, $\mathbf{514}_{13}$, $\mathbf{514}_{14}$. As a result of the spin, the feature game outcome includes an additional four (4) pearl symbols 602 beyond the initial six (6) pearl symbols 602 that triggered the hold and spin game. The additional pearl symbols 602 are presented and held at display positions $\mathbf{524}_3$, $\mathbf{524}_{10}$, $\mathbf{524}_{12}$, $\mathbf{524}_{14}$. Moreover, the game controller 202 has incremented or updated the configurable symbol meter 510 from six (6) to ten (10) to reflect the quantity of pearl symbols 602 currently displayed and held at their respective display positions. Moreover, the game controller 202 has decremented the spin meter 512 from the initial quantity of three (3) spins to reflect that two (2) spins remain. In another embodiment, the game controller 202 only decrements the spin meter 512 if a spin fails to add at least one additional configurable symbol in the feature game outcome, and therefore does not decrement the spin meter 512 if a spin adds at least one additional configurable symbols to the feature game outcome. In another embodiment, the spin meter is reset to the initial quantity (based on the volatility selection—three in this example) when at least an additional configurable symbol is included in the feature game outcome.

FIG. 6C depicts the feature game final outcome. In particular, over the remaining games of the hold and spin game, only one (1) additional pearl symbol 602 was added to the feature game outcome at display position $\mathbf{524}_4$. Upon completion of the hold and spin game, the game controller 202 presents the accumulated value of the values provided by the indicia 604 on the pearl symbols 602. In this case, the total award is 5,100 credits—the 3,600 credits for the six (6) pearl symbols 602 that originally triggered the hold and spin game plus 1,500 credits provided by the additional five (5) pearl symbols 602 obtained during play of the hold and spin game. In this embodiment, the game controller 202 totals the accumulated award at the end of the hold and spin game and transfers the accumulated ward to the win meter 508 before transferring the accumulated award to the credit meter 504. The game controller 202 adjusts the meter data 348 accordingly before the next play of the base game is initiated. In alternative embodiments, the accumulated award may bypass the win meter 508 and be credited directly to the credit meter 504.

Figure 6E:
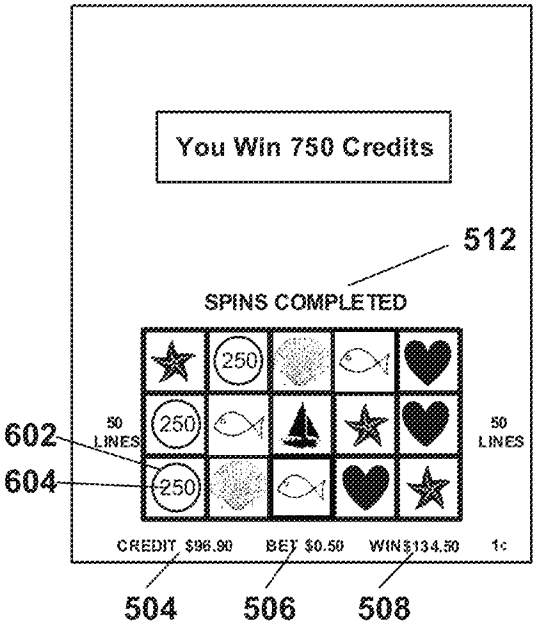
Figure 6D:
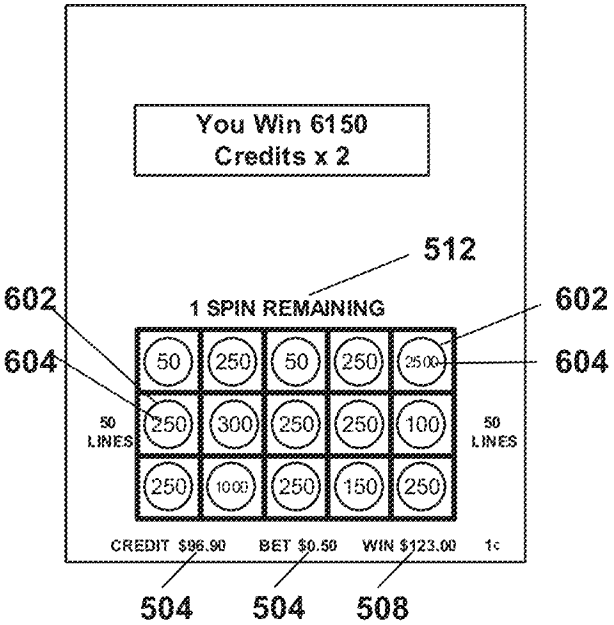

FIGS. 6D and 6E depict an alternative path from the hold and spin feature outcome of FIG. 6B. In particular, FIGS. 6D and 6E present example play of the hold and spin game that fills the matrix of display positions $\mathbf{524}_1$-$\mathbf{524}_{15}$ with configurable symbols. In particular, FIG. 6D depicts the hold and spin game of FIG. 6C after an alternative spin of the reels $\mathbf{514}_4$, $\mathbf{514}_8$, $\mathbf{514}_9$, $\mathbf{514}_{13}$, $\mathbf{514}_{14}$. As a result of the spin, the feature game outcome includes a pearl symbol 602 at each of the display positions $\mathbf{524}_1$-$\mathbf{524}_{15}$. Upon filling the matrix, the game controller 202 presents an award based on the accumulated value of the values provided by the indicia 604 on each of the pearl symbols 602 and the multiplier M for the selected volatility option 540*a*-540*c*. In this case, the accumulated value is 6,150 credits—the 3,600 credits for the six (6) pearl symbols 602 that originally triggered the hold and spin game plus 2,550 credits provided by the additional nine (9) pearl symbols 602 collected during play of the hold and spin game. In this embodiment, the game controller 202 presents the accumulated value and multiplier M and transfers the accumulated ward to the win meter 508 before proceeding with the next spin of the hold and feature game.

With the last remaining spin, the game controller 202 provided three (3) additional pearl symbols 602 at display positions $\mathbf{524}_2$, $\mathbf{524}_6$, $\mathbf{524}_{11}$. The game controller 202 sums or accumulates the values of the additional pearl symbols 602 and presents the accumulated value on the display 240. As depicted, the additional pearl symbols 602 provide an accumulated value of 750 credits. The game controller 202 may transfer these credits to the win meter 508. As reflected by the win meter 508 of FIG. 6E, the depicted instance of the hold and spin game awarded the player 13,450 credits having a value of $134.50 since the player is playing at a 1¢ denomination (i.e., each credit is valued at 1¢)

Hold and Spin Game with Repeat Pay

Figure 7A:
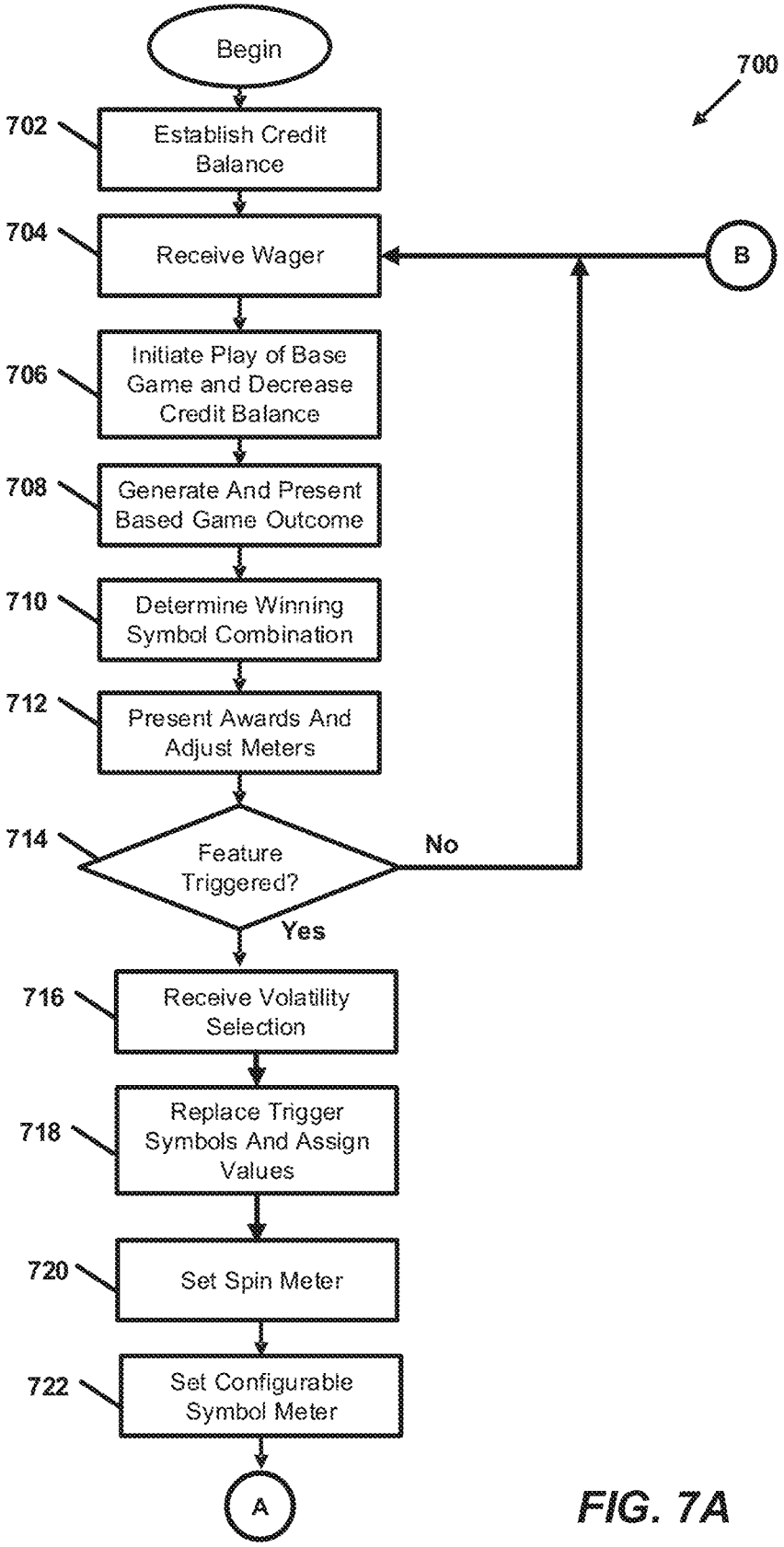
FIGS. 7A-7C provide a flowchart depicting operation of a gaming machine in accordance with a repeat pay feature game of the present disclosure.
Figure 7B:
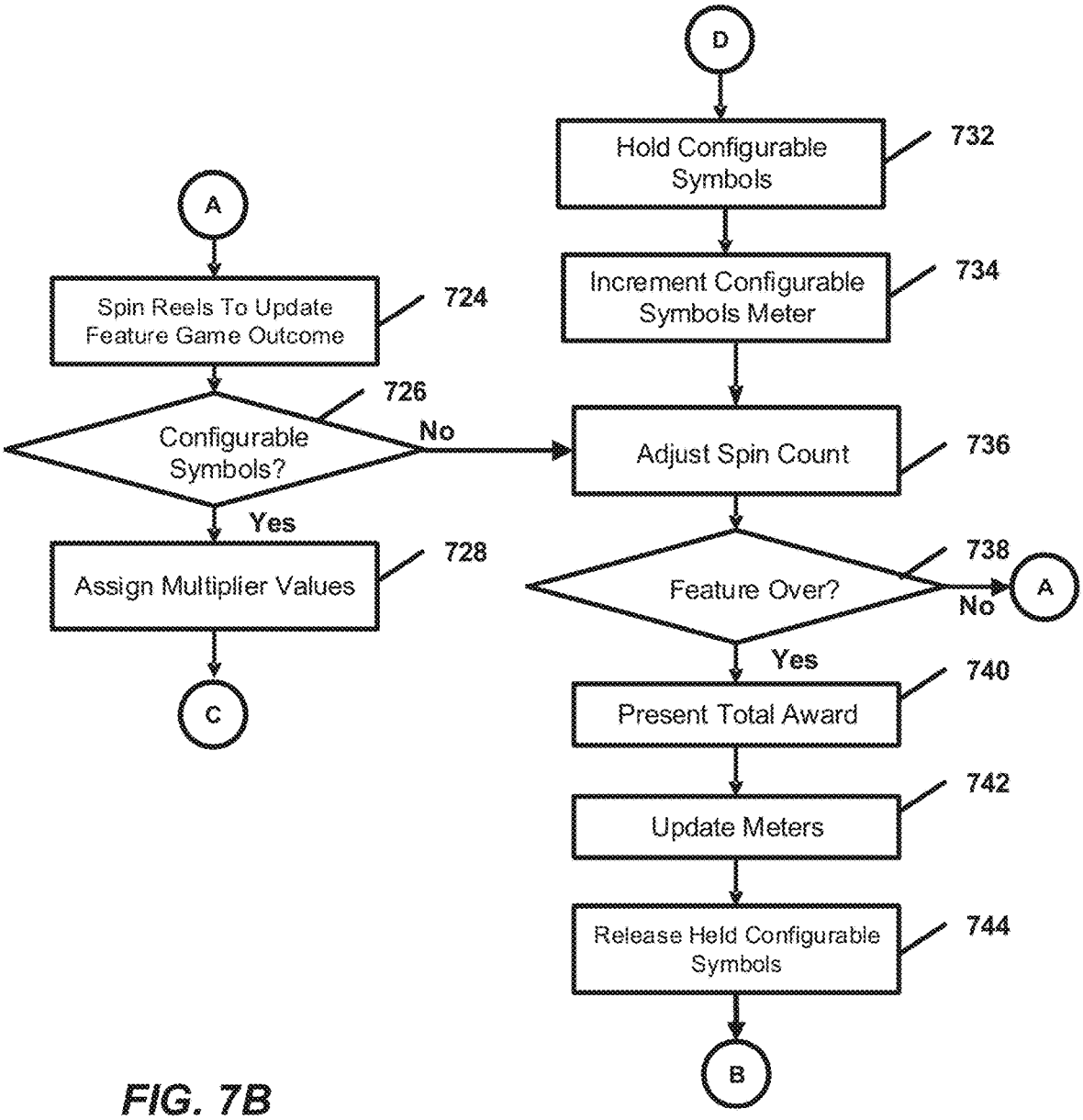
Figure 7C:
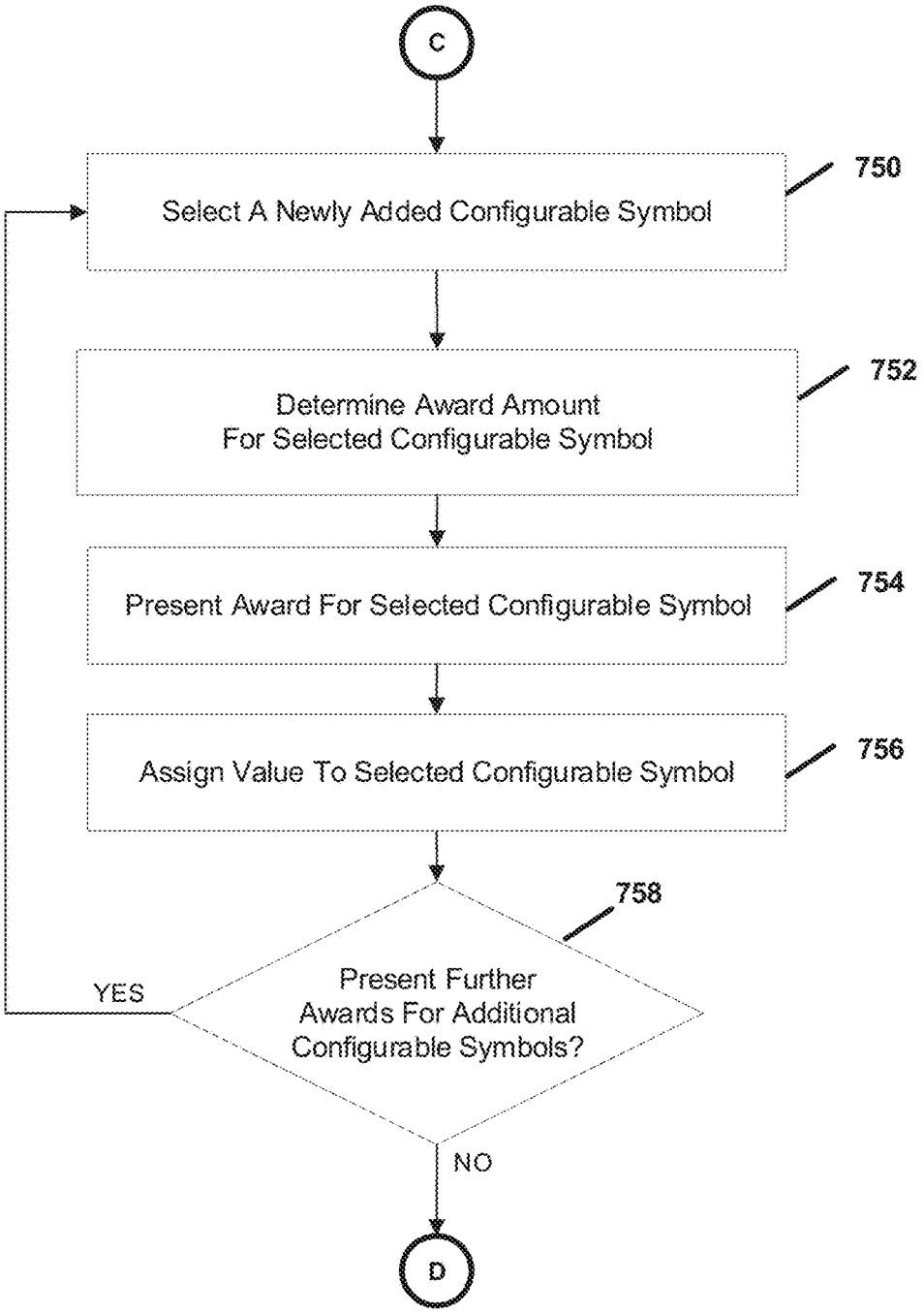

FIGS. 7A-7C provide a flowchart depicting process 700 of the gaming machine 200 for an example hold and spin game that provides a repeat pay for configurable symbols. To simply the following discussion, the gaming machine 200 awards an initial quantity of spins for the hold and spin game. However, other terms such as games, rounds, instances, etc. may be more appropriate than the term spin for other feature games. Thus, references to spins should be interpreted to include games, rounds, instances, etc. with respect to these other feature games. Moreover, while the following describes the hold and spin game as a feature game whose play is triggered or initiated based on play of a base game, the hold and spin game or aspects thereof may be part of another game such as a base game, free game, etc. and/or may be initiated without regard to play of a base game.

At 702, the game controller 202 of the gaming machine 200 may establish an associated credit value on a credit meter 504. To this end, a player may insert a physical item having monetary value into a credit input mechanism or device, such as the ticket reader 224 or bill validator 234, of the gaming machine 200. In response to the received physical item, the game controller 202 may establish a credit balance by increasing a credit value of the credit meter 504 based on the monetary value of the physical item.

At 704, the gaming machine 200 may receive a wager and update wager meter 506 to reflect the placed wager. To this end, a player may use the player input buttons 236 of the player interface to specify a wager amount with the wager amount being funded by the credit value of the credit meter 504. After receipt of the wager, the game controller 202 may display a message such as "Press SPIN to play" in a message box, e.g., on the primary game display 240. When the player presses a SPIN button, e.g., of the player input buttons 236, the game controller 202, at 706, may decrease the player's credit balance by the specified wager and initiate play of a spinning reel game by spinning reels one or more reels.

Next, at 708, the game controller 202 may stop the reels based on one or more random values generated by RNG 212 to obtain a base game outcome comprising a matrix, or any other formation, of symbols. In other embodiments, the game controller 202 may stop the reels based on information received from central determination gaming system server 106, or using a bingo game outcome.

The game controller 202, at 710, may then determine whether the display matrix includes one or more winning symbol combinations. For example, at 710, the game controller 202 may determine if there are any winning symbol combinations along one of the activated paylines. Winning symbol combinations along the activated paylines may result in the game controller 202 presenting one or more awards by increasing the credit value of the credit meter 504 based on the awards for such winning symbol combinations.

At 712, the game controller 202 may present the awards for winning symbol combinations and adjust meters (e.g., credit meter 504 and/or win meter 508) in accordance with the presented awards. To this end, the game controller 202 may control the display 240 to provide a message reflective of the game outcome. For example, when the game outcome includes one or more winning symbol combinations, the display 240 may display a message such as "Congratulations—You Won X Credits!" (where X is the number of credits won by the player). Conversely, when the game outcome does not include any winning symbol combinations, a message such as "Sorry—You Didn't Win—Spin Again" may be displayed to the player.

At 714, the game controller 202 may determine whether a feature game triggering event occurred. The feature game triggering event may occur, for example, on the occurrence of a predetermined combination of symbols, or at random, or by some other process. As discussed below with regard to FIGS. 8A-8M, a feature game triggering event occurs when a base game outcome include at least a threshold quantity, e.g., six (6), of trigger symbols. For example, the base game outcome shown in FIG. 8C triggers the feature game because it includes at least six (6) trigger symbols (star symbols). When a trigger event occurs, the game controller 202 displays a message such as "Congratulations, You Triggered The HOLD AND SPIN FEATURE Game" on the primary game display 240. In various embodiments, the minimum quantity of trigger symbols needed to trigger the feature game may be predetermined, randomly determined, based on a wager amount, or based on a base denomination of the game, etc. In certain embodiments, the trigger symbols 814 may be configurable symbols 602, or may be replaced with configurable symbols 602 before or after the triggering of the feature game. The replacement may occur as a simple reveal animation where the trigger symbol 814 reveals a value associated with the symbol, similar to the configurable symbols 602 having a value associated with them.

If the feature game is not triggered, the process returns to 704 to allow the player to continue playing the base game. Alternatively, when a feature trigger occurs, the game controller 202 may transition to a feature game as described below.

In one embodiment, the game controller 202 waits for the player to press a Start Feature button of the player interface before initiating the hold and spin game. When the player presses a Start Feature button, e.g., of the player input buttons 236, the game transitions the display 240 to present volatility options 540*a*-540*c* for the hold and spin game. (See, e.g., FIG. 8D).

In particular, the game controller 202 at 716 may cause the display 240 to present a transition or player interruption screen, which requests entry of a volatility selection. To this end, the controller may present several volatility options 540*a*-540*c* via the player interface (see, e.g., FIG. 8D) and then await a volatility selection before proceeding with the hold and spin game. For example, the game controller 202 may present the volatility options 540*a*-540*c* via the display 240 and/or player input buttons 236. The game controller 202 may receive a volatility selection that selects one of the volatility options 504A-504C in response to the player actuating a touchscreen of the display 240 or player input buttons 236 of the player interface.

Per FIG. 7A, the game controller 202 presents the player interruption screen before assigning and displaying the assigned values of the trigger symbols at 718. However, the gaming machine 200 in other embodiments may present a player with the volatility options 540*a*-540*c* and receive the player's selection at other times. For example, the volatility options 540*a*-540*c* may be provided to the player after determining that the hold and spin feature has been triggered at 714 and after assigning and presenting values to the trigger symbol at 718. In other embodiments, the gaming machine 200 may present the volatility options 540*a*-540*c* prior to initiating play of the base game at 706. Other points for presenting the volatility options 540*a*-540*c* are contemplated and may be encompassed by the appended claims.

In some embodiments, each volatility option defines an initial quantity of spins for the feature game. For example, a low volatility option may provide the hold and spin game with an initial quantity of three (3) spins, a high volatility option may provide the hold and spin game with an initial quantity of one (1) spin, and a medium volatility option may provide the hold and spin game with an initial quantity of two (2) spins.

In some embodiments, the game controller 202 waits indefinitely for the player to make their volatility selection. In other embodiments, the game controller 202 waits a predefined period of time for the volatility selection before automatically selecting one of the volatility options 540*a*-540*c* and initiating the hold and spin game. For example, the game controller 202 may (i) randomly select one of the volatility options 540*a*-540*c*, (ii) use a predefined default volatility option of the volatility options, or (iii) select one of the volatility options 540*a*-540*c* via other criteria upon expiration of the predefined period of time. Regardless of whether the player or the game controller 202 selects the volatility option, the game controller 202 proceeds with conducting the hold and spin feature per the selected volatility option.

At 718, the game controller 202 may replace the trigger symbols 814 in the base game outcome with configurable symbols 602 and assign values to the configurable symbols 602. The game controller 202 may determine the prize values assigned to the configurable symbols 602 using a random determination, using weighted tables, or having preassigned values to each trigger symbol used in the primary game reels. See, e.g., FIGS. 8C and 8D, which illustrates the trigger symbols 814 being replaced configurable symbols 602 and values assigned to the configurable symbols 602. Although not illustrated, an animation may be shown that replaces the trigger symbols 814 with configurable symbols 602 that reveal assigned values. As described above, the game controller 202 may assign values to configurable symbols 602 after the feature game is triggered. In some embodiment, the game controller 202 may assign values to the trigger symbols in the base game outcome regardless of whether the feature game is triggered by the base game.

The game controller 202 at 720 sets the spin meter 512 to an initial quantity of spins specified by the selected volatility option. For example, in an embodiment, if the low volatility option is selected, the game controller 202 sets the spin meter 512 to three (3). Similarly, if the high volatility option is selected, the game controller 202 sets the spin meter 512 to one (1). In other embodiments, the volatility options may provide various ranges of initial quantities. For example, in some embodiments, the spin meter 512 may be set to values between 1 and 8 based on the selective volatility option.

At 722, the game controller 202 sets the configurable symbol meter 510 based on the quantity of trigger symbols in the base game outcome. In one embodiment, the game controller 202 sets the configurable symbol meter 510 to reflect the quantity of trigger symbols in the base game outcome and thus the initial quantity of configurable symbols in the feature game outcome. For example, if the base game outcome triggered the hold and spin game due to the base game outcome including exactly six (6) trigger symbols, then the game controller 202 sets the configurable symbol meter 510 to six (6) to reflected the initial quantity of held configurable symbols in the feature game outcome.

After updating the meters 510, 512, the game controller 202 may display a message such as "Press SPIN to Play" on the display 240. When the player presses the SPIN button of a player interface, the game controller 202, at 724, spins reels $\mathbf{514}_1$-$\mathbf{514}_{15}$ of the matrix 804 (see, e.g., FIG. 8F) and stops such reels based on one or more random values generated by RNG 212 to obtain or update a feature game outcome. In the depicted embodiment, the stop positions of the reels $\mathbf{514}_1$-$\mathbf{514}_{15}$ select symbols from a feature game symbol set that includes both non-configurable symbols (e.g., blank symbols), and configurable symbols 602.

Moreover, the game controller 202 holds any configurable symbols 602 provided by the base game outcome (e.g., trigger symbols 814 replaced with configurable symbols 602) at their respective display positions $\mathbf{524}_1$-$\mathbf{524}_{15}$ for the remainder of the feature game. As such, when the game controller 202 spins the reels at 724, the game controller 502 spins only those reels $\mathbf{514}_1$-$\mathbf{514}_{15}$ that do not present a configurable symbol 602 at its respective display positions $\mathbf{524}_1$-$\mathbf{524}_{15}$. For example, the base game outcome of FIG. 8C includes six (6) trigger symbols 814, which were replaced with configurable symbols 602 upon the trigger of the feature game as shown at FIG. 8D. These six (6) configurable symbols 602 may be retained in their respective display positions for the remainder of the feature game.

The game controller 202, at 726, may then determine whether the spin added any additional configurable symbols 602 to the feature game outcome. If the feature game outcome does not include any new configurable symbols 602, then the game controller 202 may proceeds to 736 to adjust the spin meter 512. Otherwise, the game controller 202 at 728 may assign multiplier values to the newly added configurable symbols 602 based on the selected volatility option 540*a*-540*c*. The multiplier values may be individually determined for each configurable symbol, or a single multiplier value may be used for all the configurable symbols for that spin outcome. Each volatility option may have a range of multiplier values associated with it. These multiplier values may be stored in one or more (one for each volatility option) data tables, such as weighted tables.

Figure 8A:
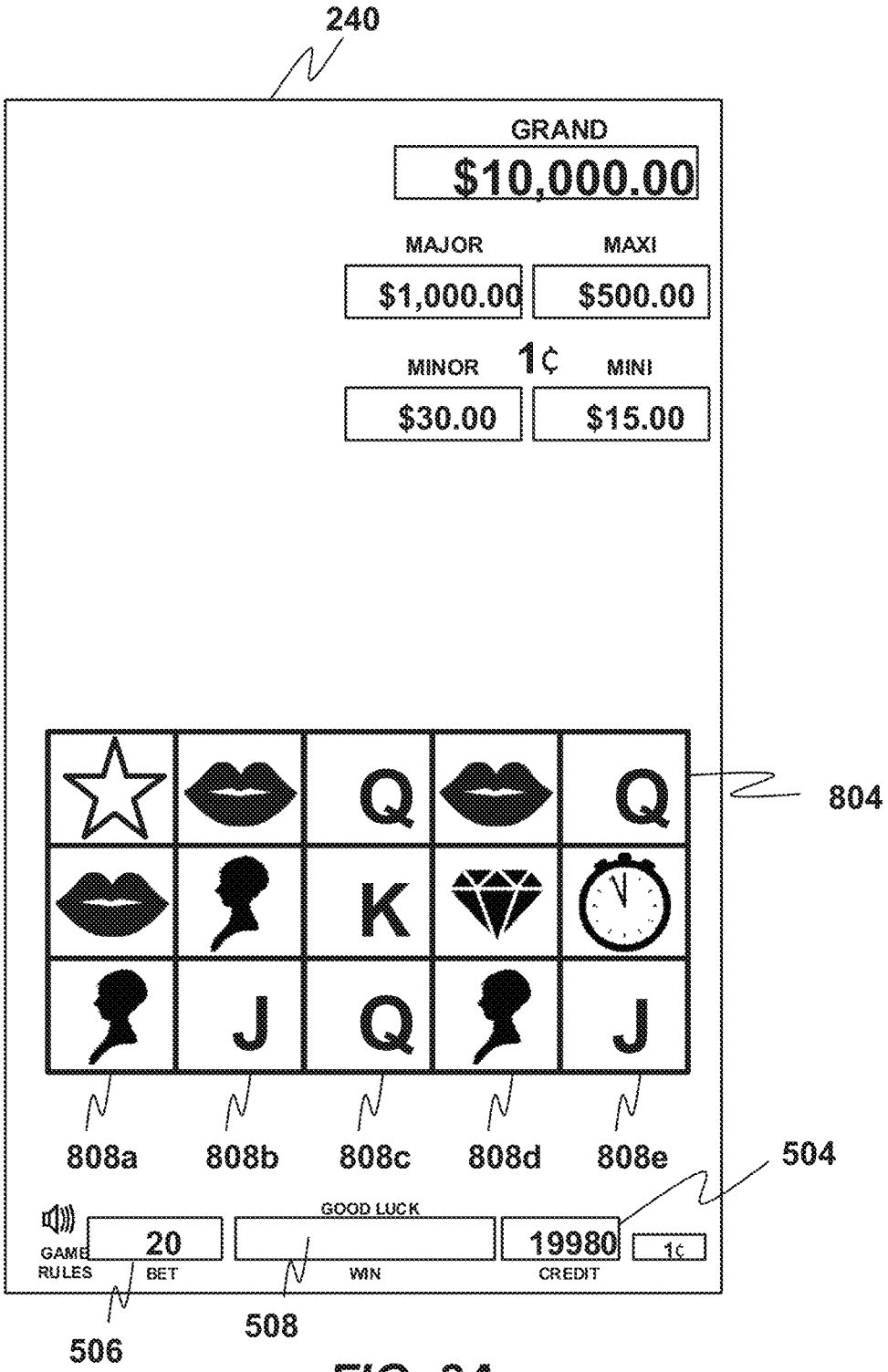
FIGS. 8A-8M present a series of display screens depicting operation of the gaming machine per the process of FIGS. 7A-7C.
Figure 8B:
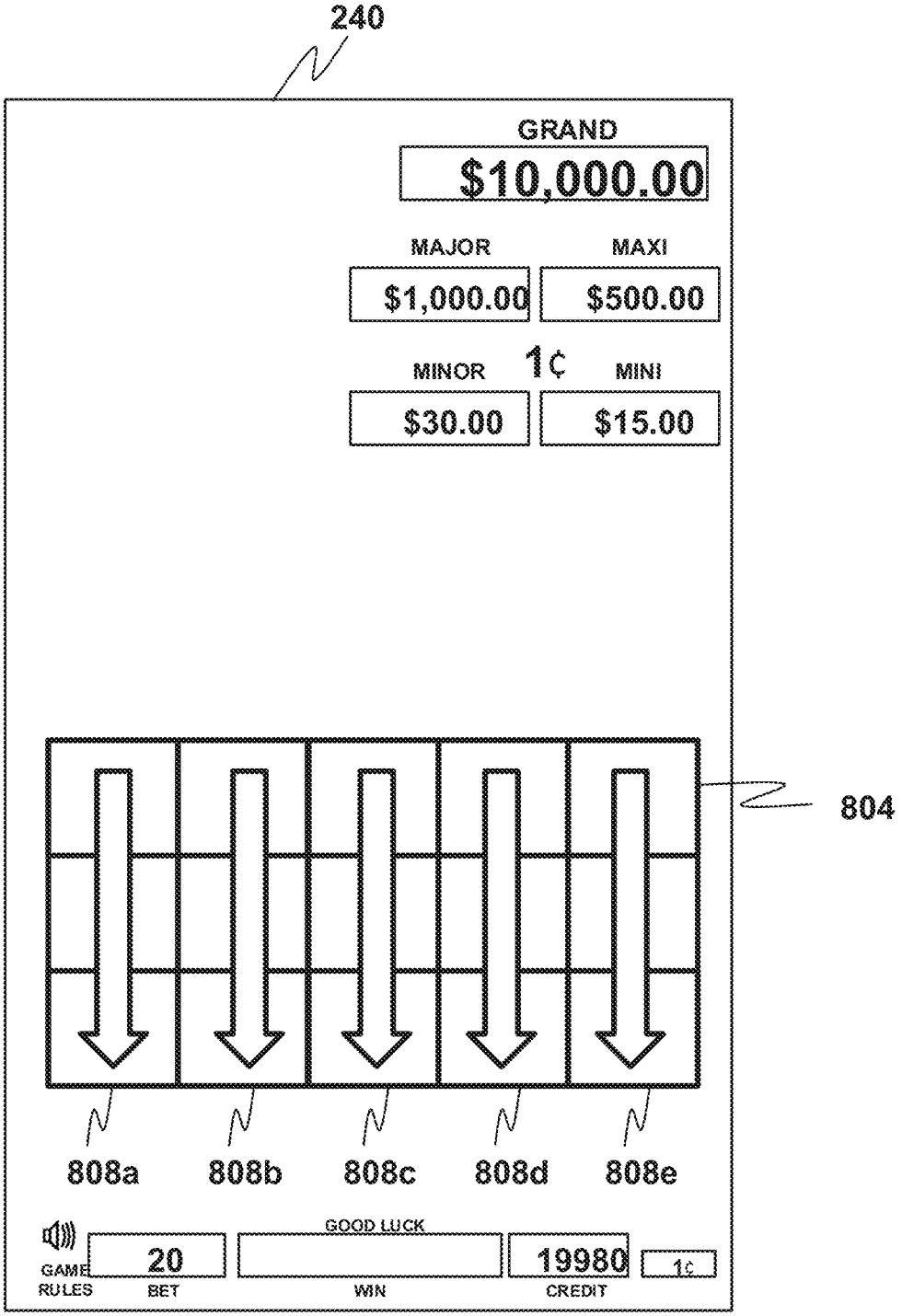
Figure 8C:
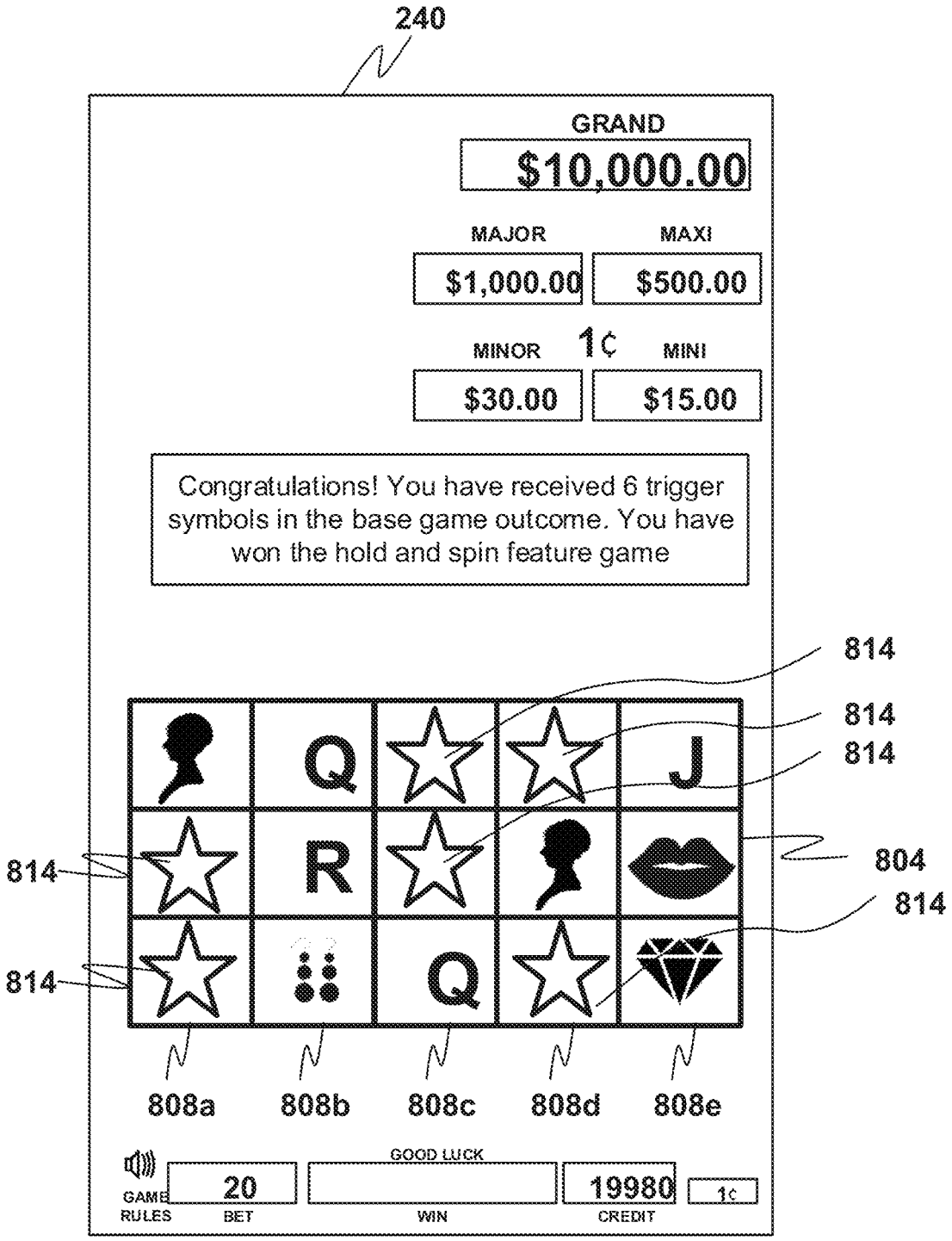
Figure 8D:
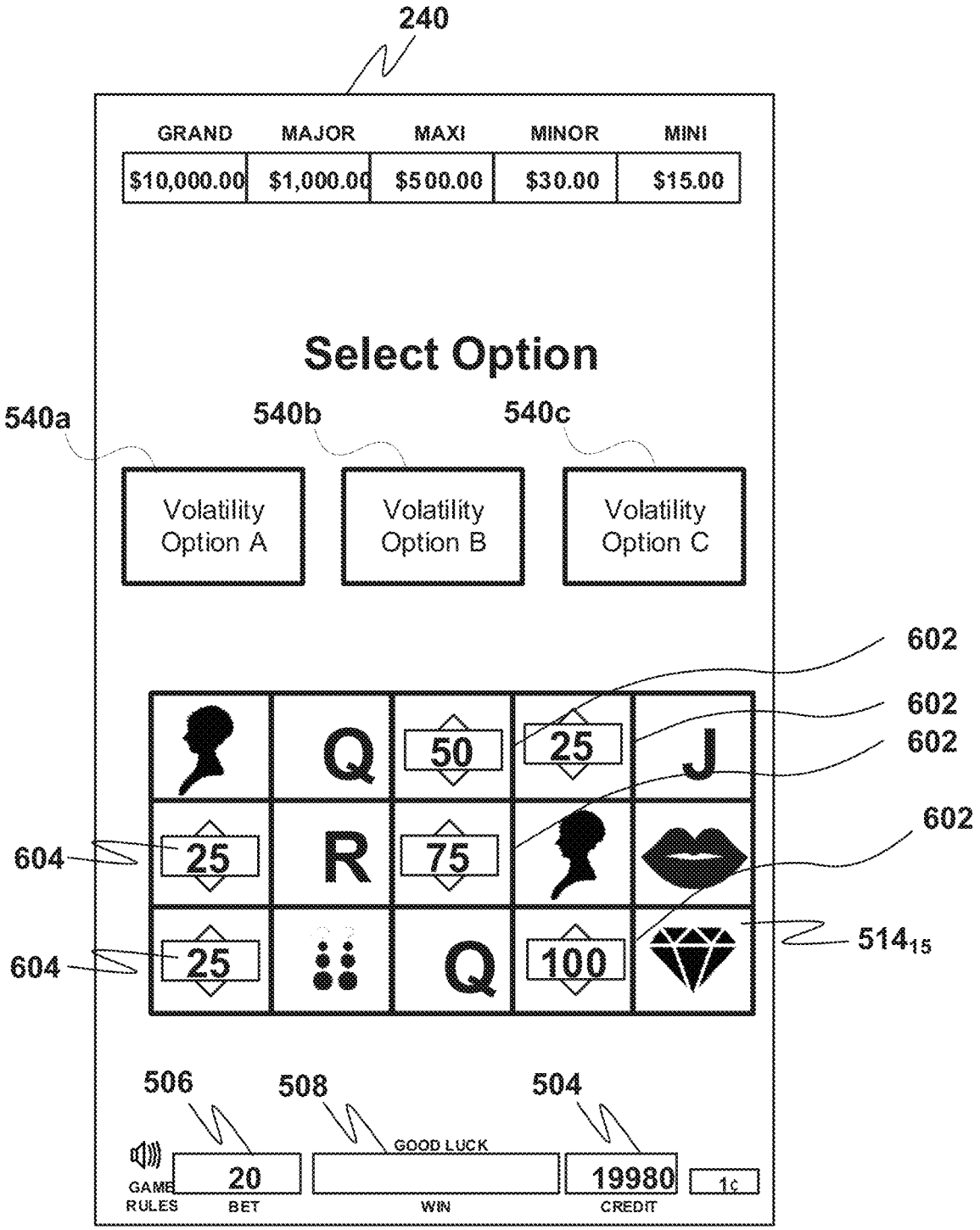
Figure 8E:
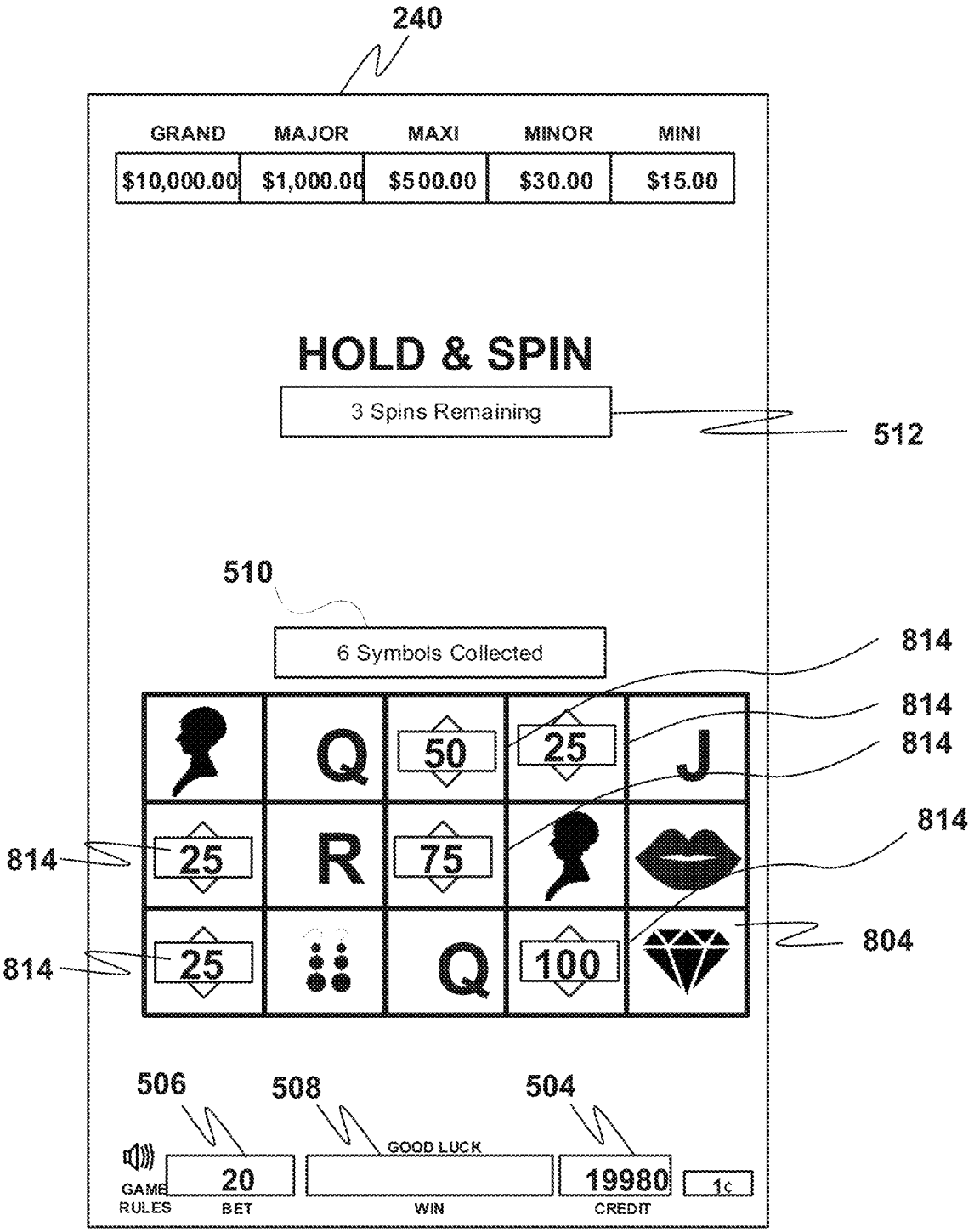
Figure 8F:
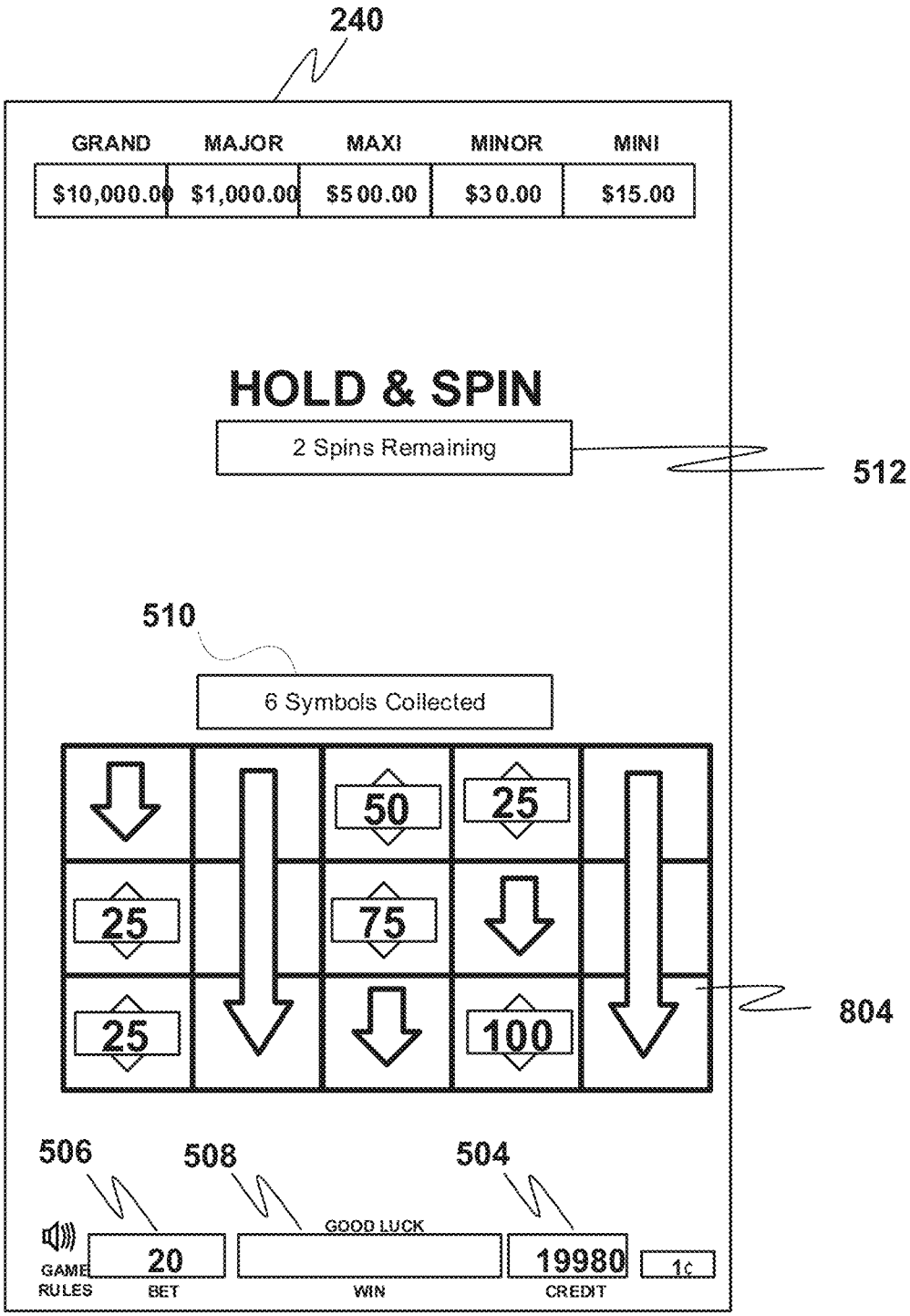
Figure 8G:
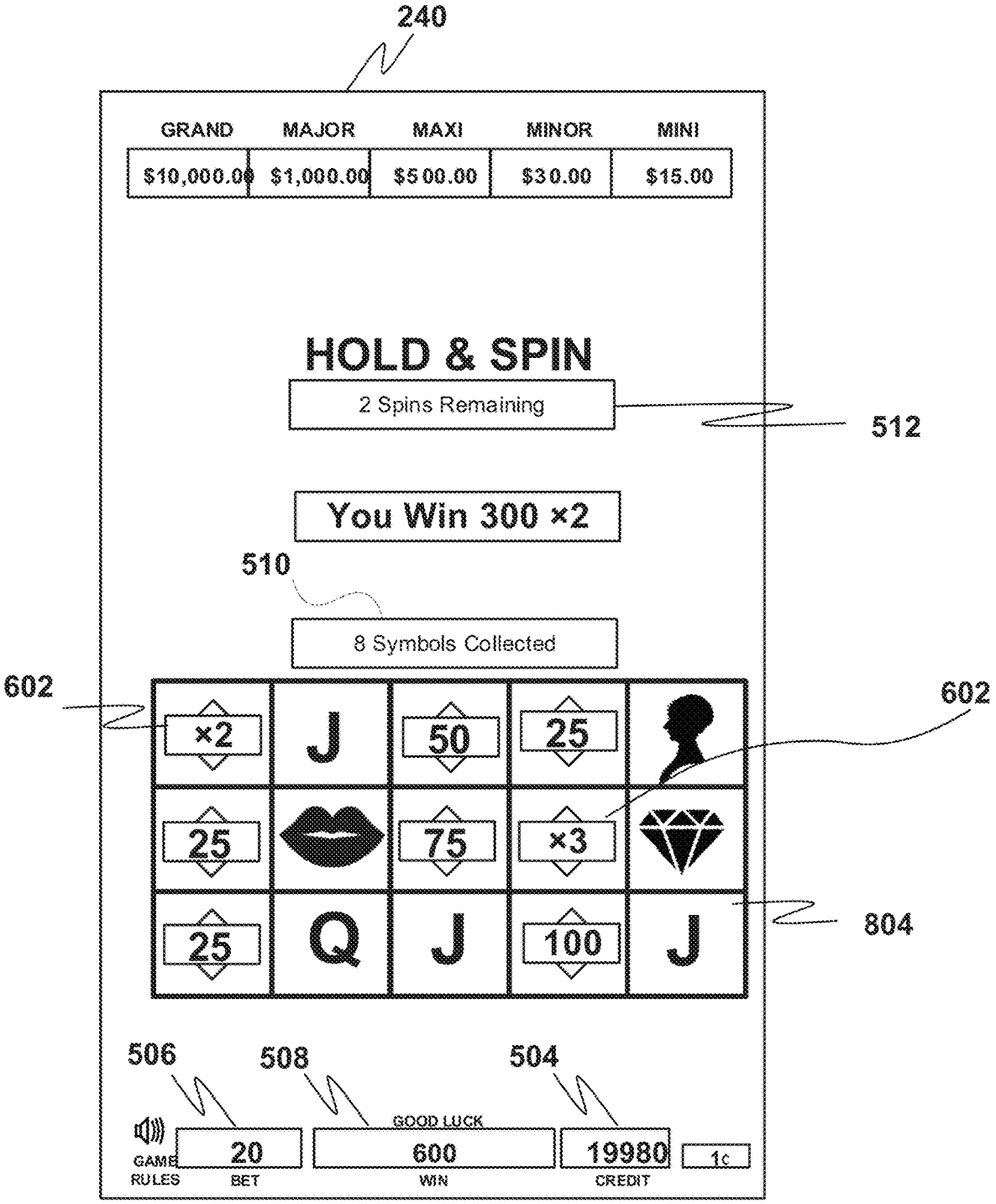

In the illustrated example of FIG. 8G, the spin resulted in two additional configurable symbols 602 being added to the feature game outcome. The game controller 202 may assign and reveal multiplier values for the newly added the configurable symbols 602. Namely, per the illustration of FIG. 8G, the game controller 202 assigned a ×2 multiplier value to one of the newly added configurable symbols 602 and assigned a ×3 multiplier value to the other newly added configurable symbol 602.

The game controller 202 may then present awards for the newly added configurable symbols 602 in accordance with a repeat pay procedure presented in FIG. 7C. FIG. 7C provides a flowchart depicting an iterative award or repeat pay process for determining the award amount for a spin of a feature game, in accordance with various embodiments of the present disclosure. Per the process of FIG. 7C, the game controller 202 generally determines the award for a current spin of the feature game based on (i) configurable symbols 602 in the feature game outcome that were obtained during previous spins, and (ii) additional configurable symbols added to the feature game outcome per the current spin. As explained below, in some embodiments, the game controller 202 determines that the award for a given spin is zero if the given spin failed to add any additional configurable symbols 602 to the feature game outcome. In such embodiments, the additional configurable symbols 602 may be considered to trigger a payout or additional award.

To this end, the game controller 202 at 750 may select one of the newly added configurable symbols 602. In one embodiment, the game controller 202 selects newly configurable symbols 602 in a predefined order. For example, the game controller 202 may select symbols left-to-right and top-to-bottom. In such an embodiment, a newly added configurable symbols 602 at display position $524_1$ is selected before a newly added configurable symbol at display position $524_2$, and so on. In other embodiments, the game controller 202 may select newly added configurable symbols in a random order, in an increasing multiplier value order, in an increasing revealed value order, etc. Other manners of selecting a configurable symbol are contemplated and may be encompassed by the appended claims.

As explained above, a spin of the hold and spin game may involve spinning the reels $514_1$-$514_{15}$ associated with display positions $524_1$-$524_{15}$ without a configurable symbol 602, while holding or retaining any configurable symbols 602 in the feature game outcome at their respective display positions $524_1$-$524_{15}$. As such, the game controller 202 at 750 may only considering those symbols of that were not held from any previous spin. For example, when determining whether a first spin of the hold and feature game includes any additional configurable symbols, the game controller 202 may exclude from such determination at 750 any configurable symbols 602 provided by the base game outcome.

The game controller 202 at 752 determines an award for the selected configurable symbol 602. In particular, the game controller 202 may determine the award by summing the displayed prize values of the held configurable symbols and multiplying the sum by the multiplier value assigned to the selected configurable symbol. For example, in FIG. 8G, the game controller 202 has selected the configurable symbol 602 with the ×2 multiplier value. The award for the selected configurable symbol is 300 credits, which is the sum of the displayed values for the six (6) held configurable symbols, multiplied by two (2), which is the multiplier value assigned to the selected configurable symbol 602.

At 754, the game controller 202 may present the award determined for the selected configurable symbol 602. For example, with regard to FIG. 8G, the game controller 202 may present a message on the display 240 that indicates that 300 credits time two (2) were awarded for the selected configurable symbol 602. The game controller 202 may further present the award by updating one or more meters (e.g., win meter 508) based on the award for the selected configurable symbol 602.

At 756, the game controller 202 may assign a prize value to the selected configurable symbol 602. The game controller 202 may replace the multiplier value assigned to the selected configurable symbol with a prize value. To this end, the game controller 202 may determine the prize value and assign the value to the selected the configurable symbols 602 in the same manner used to assign prize values to the configurable symbols at 716. For example, the game controller 202 may determine the prize value using a random determination, using weighted tables, or having preassigned values to each configurable symbol 602 on the reels $514_1$-$514_{15}$. For example, the game controller 202 assigned a value of 100 credits to the configurable symbol at display position $524_1$ in FIG. 8H.

At 758, the game controller 202 determines whether further awards need to be presented for additional configurable symbols 602 in the feature game outcome. If no further awards need to presented (e.g., no further configurable symbols 602 with multiplier values), then the game controller 202 may end the repeat pay process and return to 732 of FIG. 7B. Otherwise, the game controller returns to 750 to select and process the next additional configurable symbol 602 in the feature game outcome.

In certain embodiments, the game controller 202 proceeds from 728 to 732 skipping the repeat pay process of FIG. 7C. In such embodiments, the game controller 202 may carry out the feature game until no additional spins remain (or any other terminating condition) and determine an award amount on the basis of the values of any configurable symbols and any multipliers that may be provided based on the volatility selection.

At 732, the game controller 202 holds the additional configurable symbols of the feature game outcome. The game controller then increments the configurable symbol meter 510 at 734 to reflect the quantity of held configurable symbols in the feature game outcome. As such, the configurable symbol meter 510 reflects the quantity of configurable symbols 602 collected by the player in the hold and spin game. Next, at 736, the game controller 202 adjusts the spin meter 512. As noted above, the feature game may start with an initial quantity of spins as specified by the selected volatility option. In response to initiating a spin of the feature game, the game controller 202 may decrease the spin meter 512 by a defined quantity, e.g., one. After the completion of a spin, the game controller 202 may further adjust the spin meter 512 based on the outcome of the spin. For example, when the spin results in the feature game outcome including one or more additional configurable symbols, the game controller 202 may increase the spin meter 512. In some embodiment, the game controller 202 increments the spin meter 512 by a predefined quantity (e.g., 1). In other embodiment, the game controller 202 increments the spin meter 512 by the quantity of additional configurable symbols added to the feature game outcome. In yet other embodiments, the game controller 202 increments the spin meter 512 by the initial quantity of spins as specified by the selected volatility option. In some embodiments, the game controller 202 resets the spin meter 512 to the initial quantity of spins specified by the selected volatility option. In certain embodiments, the game controller 202 may not increment the spin meter 512 or may wait until all of the initial quantity of spins are completed before incrementing the spin meter 512.

At 738, the game controller 202 determines if the feature game is over. Specifically, the game controller 202, in certain embodiments, ends the hold and spin game if the spin meter 512 indicates no spins remain or if the matrix 804 has been filled with configurable symbols. If the feature game is not over, the game controller 202 returns to 724 and waits for the player to press the spin button of a player interface to initiate another spin of the hold and spin game. Thus, game controller 202 may continue with the hold and spin game in the manner described until all of the spins have been completed or until the display matrix is filled with configurable symbols.

However, if the hold and spin game is over, the game controller 202 at 740 may determine and/or present the total award for the configurable symbols in the feature game final outcome and updates the established credit balance accordingly. If the matrix is not completely filled with configurable symbols, the game controller 202 may sum awards from each spin of the feature game. A win meter 508 may be maintained during the play of the feature game which tallies the award from each spin of the feature game. An enhanced award may be provided for completely filling the display matrix 804 with configurable symbols. In some embodiments, the enhanced award may be a fixed prize such as a 2× multiplier of the accumulated value, or one or more of the jackpot prizes. In some embodiments, the enhanced award may be determined via a second valuation game or via a selected volatility option. For example, a wheel with various enhancements specified by the volatility option may be spun to randomly determine the enhancement to be applied to the accumulated value.

Upon determining the award, the game controller 202 at 742 may further update the players credit balance based on the hold and spin feature game award. For example, the game controller 202 may transfer credits on the win meter 508 to the credit balance maintained by the credit meter 504. Next, at 744, the game controller 202 releases the held configurable symbols 602 and returns to 704 to permit further play of the base game.

In various embodiments, instead of, or in addition to the multiplier values for each configurable symbol, the value associated with each configurable symbol may be selected prior to the spin, or alternatively determined after it is determined by the controller that one or more configurable symbol is selected to display in the matrix. The values may be selected based on the selected volatility option. For example, each volatility option may be associated with a table or set of values. The low volatility option may be associated with a set of values that are generally lower, whereas the high volatility option may be associated with a set of values that are generally higher. The set of values may overlap. The set of values may be weighed differently such that the average value for the low volatility option is lower than the average value for the high volatility option. A random selection process may be used to select a value from the set of value for each configurable symbol that is selected for a round of the feature game.

Further, in certain examples, the set of values used to determine the value of the configurable symbols may be modified based upon the values of the triggering configurable symbols. For example, a sum of the values of the configurable symbols displayed that trigger the feature game may be determined and then that value may be used to modify the set of values to be used based on the selected volatility option. For example, each value in the set may be reduced by an amount that is based on that sum. If there are 10 values in the set, then each value may be reduced by $1/10^{th}$. In other examples, the probability of selection of a configurable symbol in each position not occupied by a configurable symbol may be adjusted.

Example Play Though of Hold and Spin Game with Repeat Pay

FIGS. 8A-8M represent screen shots of a display, such as the primary game display 240, at different phases during play of a base game and an ensuing hold and spin game according to some embodiments of the present disclosure. The game in these embodiments is illustrated as having a glamor theme, where the game symbols display glamor-related elements. In this regard, the non-configurable symbols may, for example, include people, watches, diamonds, lips, lipstick, ear rings, etc. (See, e.g. FIG. 8A). As in the prior embodiments, the configurable symbols 1102 are illustrated first as star shaped reveal symbols and then as a rectangle overlying a diamond (See, e.g., FIG. 8C-D). As discussed above, some embodiments may include multiple types of configurable symbols, such as value symbols, repeater symbols, mystery symbols, and/or jackpot symbols.

FIGS. 8A-8C illustrate the primary game display 240 during play of the base game. Briefly, FIG. 8A presents the display 240 of a 3×5 display matrix 804, where each column represents a different reel 808*a*, 808*b*, 808*c*, 808*d*, 808*e*, prior to initiating play of the base game. The examples of FIGS. 8A-8M utilize a 3×5 display matrix 804 of display positions $\mathbf{524}_1$-$\mathbf{524}_{15}$. However, in other embodiments, the gaming machine 200 may present the display positions in a non-matrix arrangement. Moreover, the quantity of reels and/or the quantity of symbols positions per reel may be varied without departing from the scope of the present disclosure.

In response to the initiating the base game, the game controller 202 spins the reels 808*a*-808*e* as shown in FIG. 8B. The game controller 202 then stops the reels 808*a*-808*e* at randomly determined reel stop positions to present a base game outcome in the display matrix 804 as shown in FIG. 8C. As shown, the game controller 202 may present a credit meter 504 depicting the current credit balance, a wager meter 506 depicting the current wager, and a win meter 508 depicting the current winnings via the primary game display 240. The base game outcome of FIG. 8C includes six (6) trigger symbols 814. In this particular example, at least six (6) trigger symbols are required to initiate the feature game. As described herein, once the feature game is triggered, the game controller 202 replaces the trigger symbols 814 with configurable symbols 602. In certain embodiments, the trigger symbols 814 are configurable symbols 602 and the game controller 202 may reveal a value associated with each trigger symbol 814 upon triggering of the feature game.

FIG. 8D illustrates the primary game display 240 after the initiation of the feature game. In this particular example, the game controller 202 replaces the trigger symbols 814 of FIG. 8C with configurable symbols 602 and assigns values to each of the configurable symbols 602. Furthermore, the game controller 202 presents volatility options 540*a*-540*c* via the primary game display 240 and waits for the player to select one of the volatility options 540*a*-540*c*, before proceeding with the feature game.

After receiving the volatility selection, the game controller 202 at FIG. 8E, presents the feature game, which is a hold and spin game, and the initial quantity of spins via the spin meter 512. In one embodiment, the initial quantity of spins is specified by the selected volatility options 540*a*-540*c*. For this example, it is assumed that the player selected a volatility options 540*a*-504C providing three (3) spins, as shown in spin meter 512.

FIGS. 8E-8M depicts an example play of the feature game per the selected volatility option 540*a*-540*c*. In particular, the feature game is in the form of a hold and spin game in which any trigger symbol 814 of the triggering base game outcome are carried over to the feature game as configurable symbols 602. The game controller 202 retains or holds the configurable symbols 602 in the display matrix 804 at their respective display positions $\mathbf{524}_1$-$\mathbf{524}_{15}$ and awards the player an additional quantity of spins (e.g., three (3) in the illustrated example) per the selected volatility option 504A-504C. A goal of the feature game is to accumulate further configurable symbols 602 via the additional quantity of spins. A spin meter 512 may be displayed to indicate the quantity of spins remaining in the feature game.

FIG. 8F shows the display 240 during an initial spin of the feature. As shown in FIG. 8F, the configurable symbols 602 provided by the base game outcome are held in their respective display positions, while replacement symbols for the other display positions (i.e., display positions with the non-configurable symbols) are selected. In certain embodiments, the game controller 202 selects and presents the replacement symbols by spinning reels, as shown in FIG. 8F. In certain embodiments, the gaming machine 200, during the feature, provides a separate reel $\mathbf{514}_1$-$\mathbf{514}_{15}$ for each display position $\mathbf{524}_1$-$\mathbf{524}_{15}$ in display matrix 804. See, e.g., FIG. 5. To select replacement symbols, the game controller 202 selects a reel stop for each reel $\mathbf{514}_1$-$\mathbf{514}_{15}$ that corresponds to a non-configurable symbol, spins and stops the respective reels $\mathbf{514}_1$-$\mathbf{514}_{15}$ at their selected reel stop. As such, the game controller 202 retains the configurable symbols 602 by holding/locking reels $\mathbf{514}_3$, $\mathbf{514}_4$, $\mathbf{514}_6$, $\mathbf{514}_8$, $\mathbf{514}_{11}$, $\mathbf{514}_{14}$ and spinning reels $\mathbf{514}_1$, $\mathbf{514}_2$, $\mathbf{514}_5$, $\mathbf{514}_7$, $\mathbf{514}_9$, $\mathbf{514}_{10}$, $\mathbf{514}_{12}$, $\mathbf{514}_{13}$, $\mathbf{514}_{15}$ which do not present a configurable symbol 602 at their respective display positions $\mathbf{524}_1$, $\mathbf{524}_2$, $\mathbf{524}_5$, $\mathbf{524}_7$, $\mathbf{524}_9$, $\mathbf{524}_{10}$, $\mathbf{524}_{12}$, $\mathbf{524}_{13}$, $\mathbf{524}_{15}$.

FIG. 8G shows the display 240 following completion of initial spin of the feature game. In this example, the initial spin resulted in a feature game outcome with the six (6) configurable symbols 602 provided by the base game outcome and an additional two (2) configurable symbols 602 at display positions $\mathbf{524}_1$, $\mathbf{524}_9$. The game controller 202 may further assign multiplier values to each of the additional configurable symbols 602. In particular, the game controller 202 selects multiplier values based on the selected volatility option 540*a*-540*c*. In various embodiments, configurable symbols 602 and their assigned multiplier values may not be displayed until after all the reels have stopped spinning. For example, another symbol may be shown while the reels are spinning and/or immediately after the reels have stopped. This symbol may be the trigger symbol 814 used in the base game. The game controller 202 may replace such symbols (e.g., trigger symbols 814) with configurable symbols 602 and assigned multiplier values. Regardless, the game controller 202 may update the configurable symbol meter 510 to reflect the quantity of configurable symbols 602 in the feature game outcome. As such, the configurable symbol meter 510 of FIG. 8G notes there is eight (8) configurable symbols in the feature game outcome.

Figure 8H:
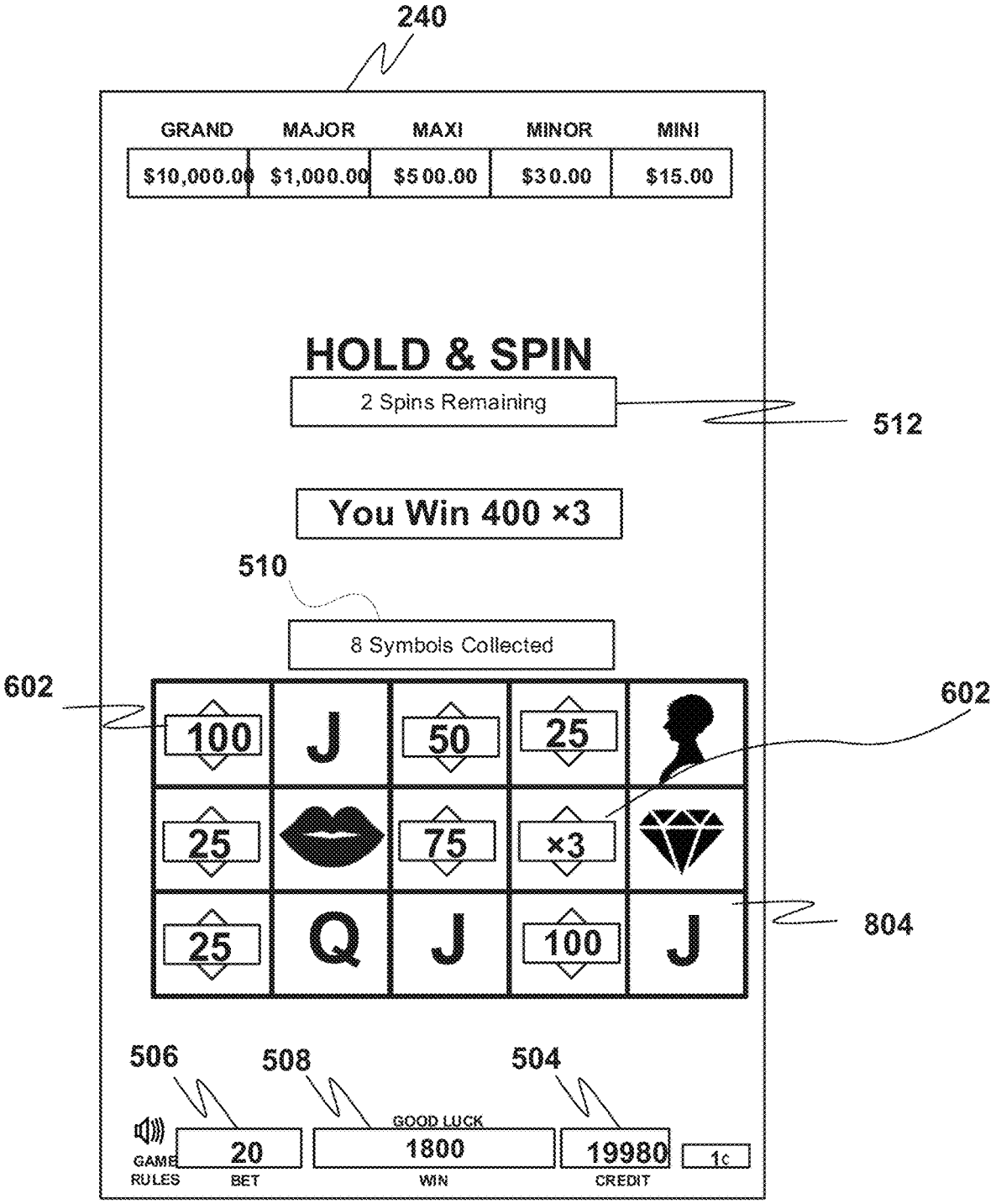

In response to obtaining at least one additional configurable symbol 602, the game controller 202 presents an award based on the values and multipliers assigned to the configurable symbols 602. The feature game outcome of FIG. 8G includes two additional configurable symbols 602. The game controller 202 determines and presents a separate award for each of the configurable symbols 602. FIG. 8H depicts the result of the game controller selecting and presenting an award for the configurable symbol 602 with the ×2 multiplier. For example, the game controller 202 may display a message 1060 on display 240 that informs the player of the awarded amount. In particular, the game controller 202 presents an award of 300 credits, which is the displayed value of the six (6) configurable symbols, and indicates that the 300 credits is multiplied by 2 due to the selected configurable symbol 602 with the ×2 multiplier. The game controller 202 may further update the win meter 508 to include the total award of 600 credits as shown.

After presenting the award for the selected configurable symbol 602 with the ×2 multiplier, the game controller 202 may assign and/or reveal a value to the selected configurable symbol 602. As shown in FIG. 8H, the game controller 202 assigned the selected configurable symbol 602 a value of 100 credits. Moreover, the game controller 202 may select the remaining configurable symbol 602 with the ×3 multiplier and present an award for the newly selected configurable symbol 602. As shown, FIG. 8H the new award is 400 credits, which is the displayed value of the now seven (7) configurable symbols with revealed values, multiplied by 3. As shown, the game controller 202 may further update the win meter 508 to include the 1200 (400×3) newly-awarded credits.

Figure 8I:
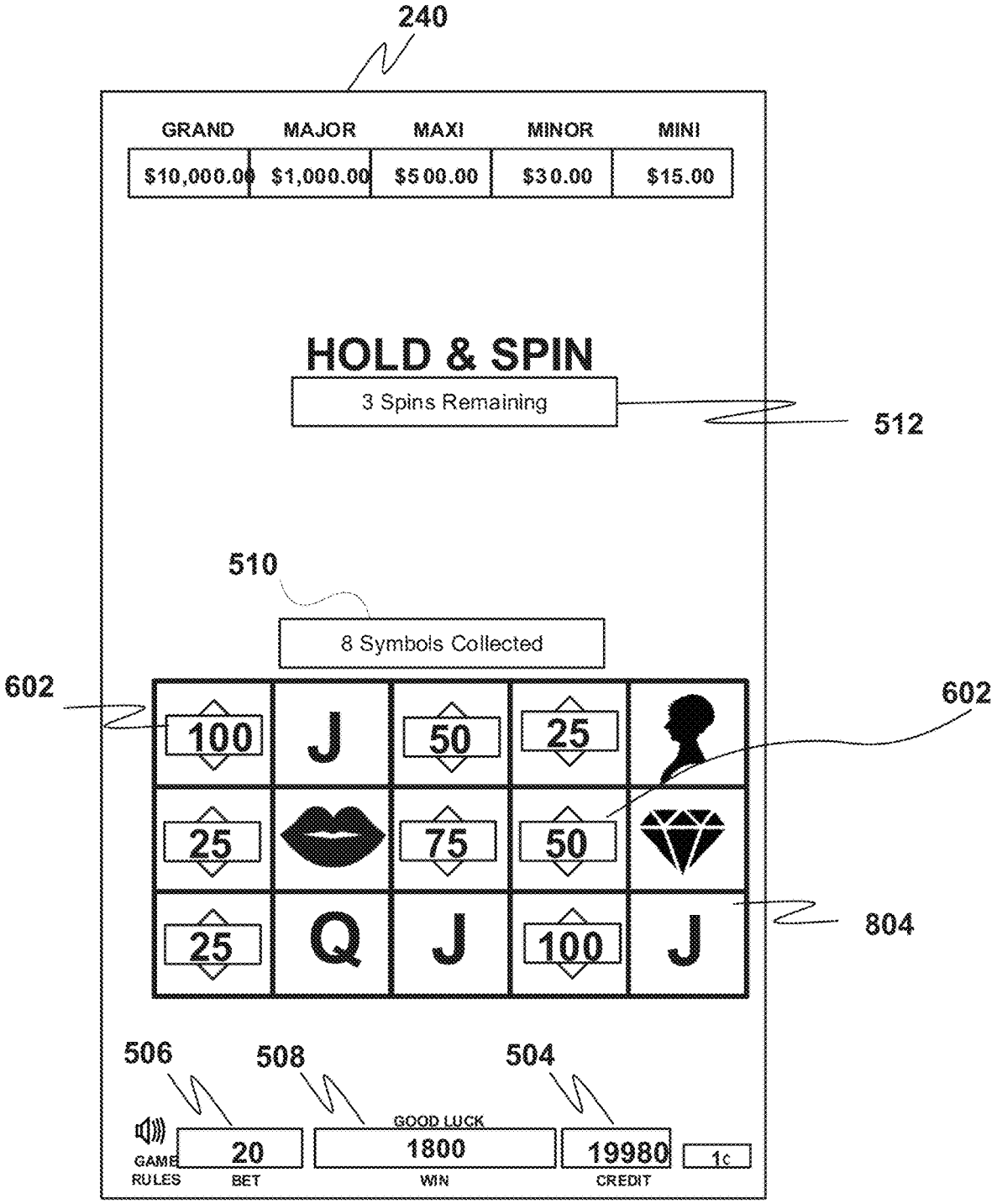
Figure 8J:
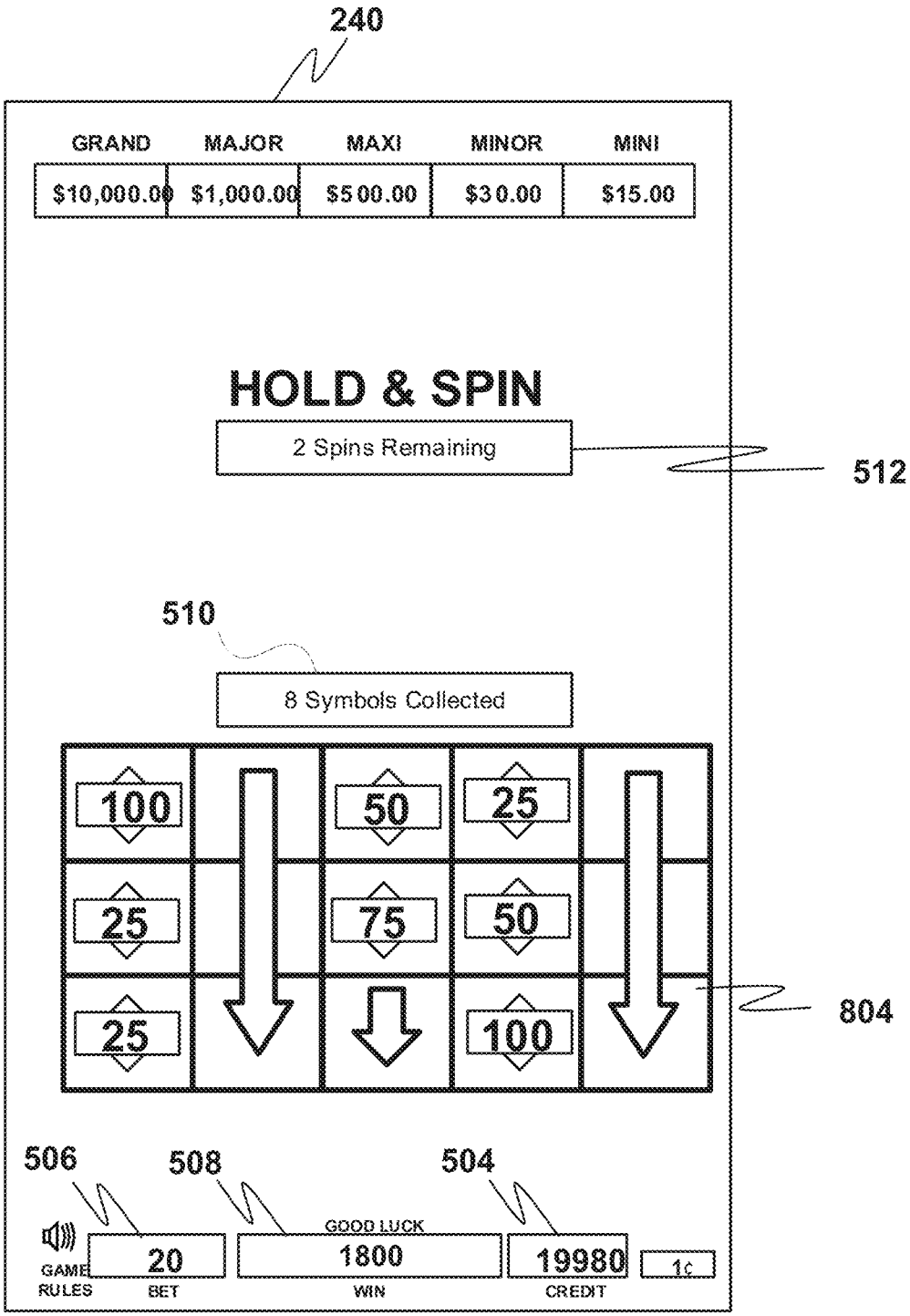
Figure 8K:
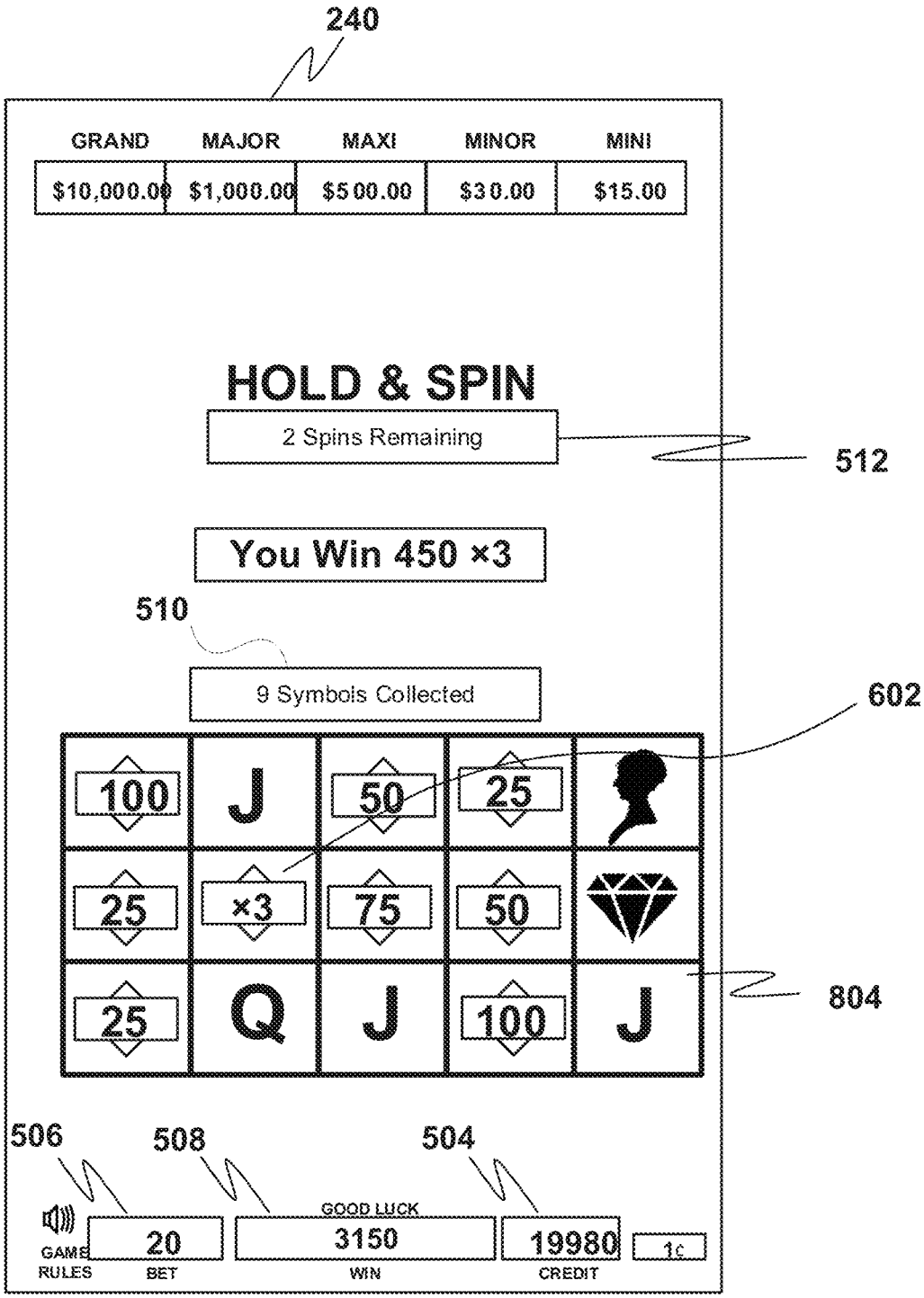

After presenting the award for the selected configurable symbol 602 with the ×3 multiplier, the game controller 202 may assign and/or reveal a value to the configurable symbol 602 with the ×3 multiplier. As shown in FIG. 8I, the game controller 202 assigned the selected configurable symbol 602 a value of 50 credits. Since the game controller 202 has presented awards for each of the two (2) additional configurable symbols in the feature game outcome, the game controller 202 has completed the presenting awards for the first spin. The total award amount of 1800 credits for the first spin (i.e., the sum of the first award and the second award) is shown on the win meter 508.

Figure 8L:
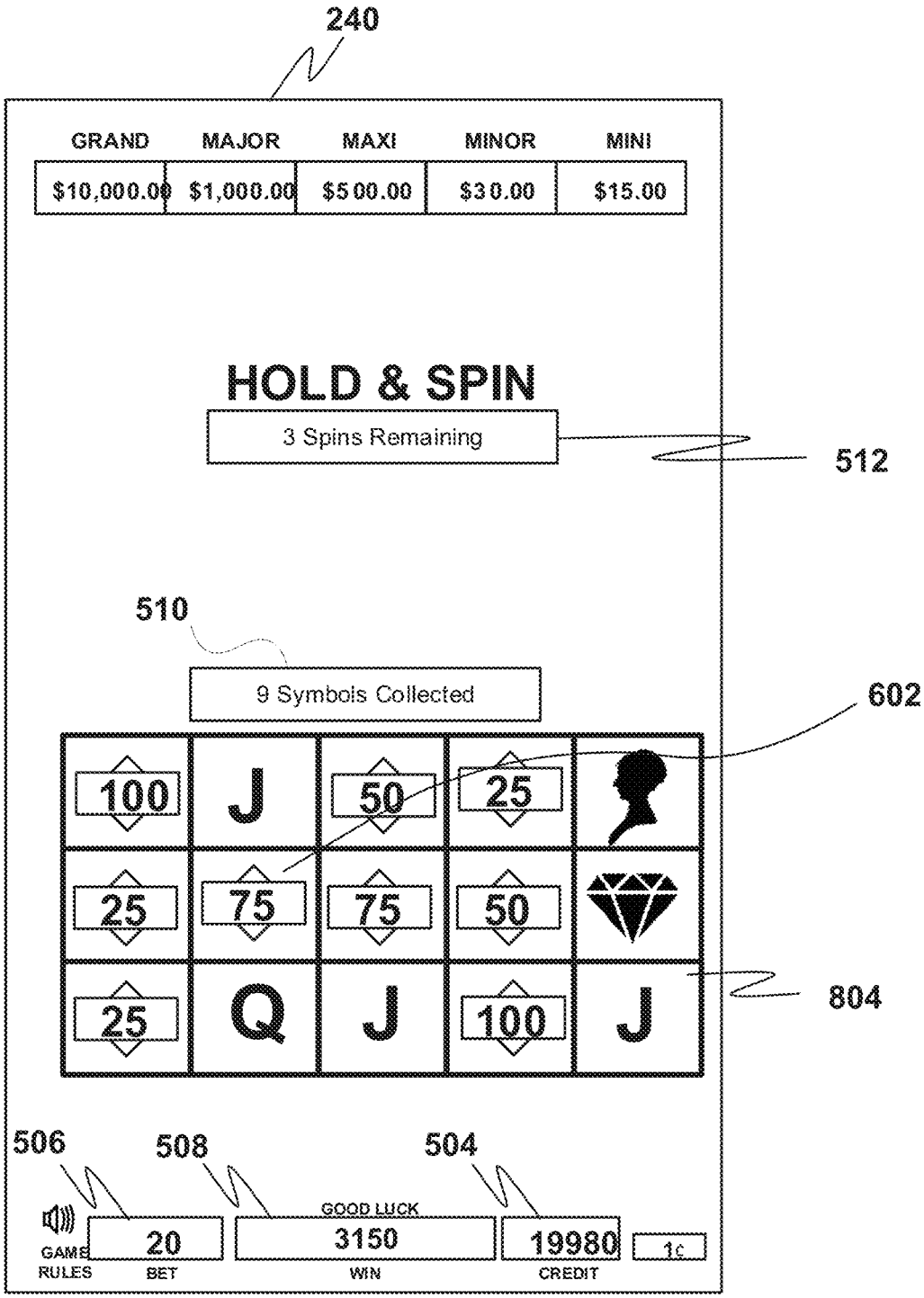

After presenting the award for the selected configurable symbol 602, the game controller 202 may assign a value to the configurable symbol 602. As shown in FIG. 8L, the game controller 202 assigned the selected configurable symbol 602 a value of 75 credits. Since the game controller 202 has presented awards for the one (1) additional configurable symbol in the feature game outcome, the game controller 202 has completed the presenting awards for the second spin. The total award amount of 3150 credits for the first spin and the second spin is shown on the win meter 508. Moreover, since the spin added at least one additional configurable symbol to the feature game outcome, the game controller 202 resets spin meter 512 to the initial quantity of three (3) spins as specified by the selected volatility option 540*a*-540*c*. Of note, the newly revealed 75 credits of the configurable symbol has not been awarded and will not be award until a next spin, if any, adds additional configurable symbols to the feature game outcome and/or the feature game ends.

Figure 8M:
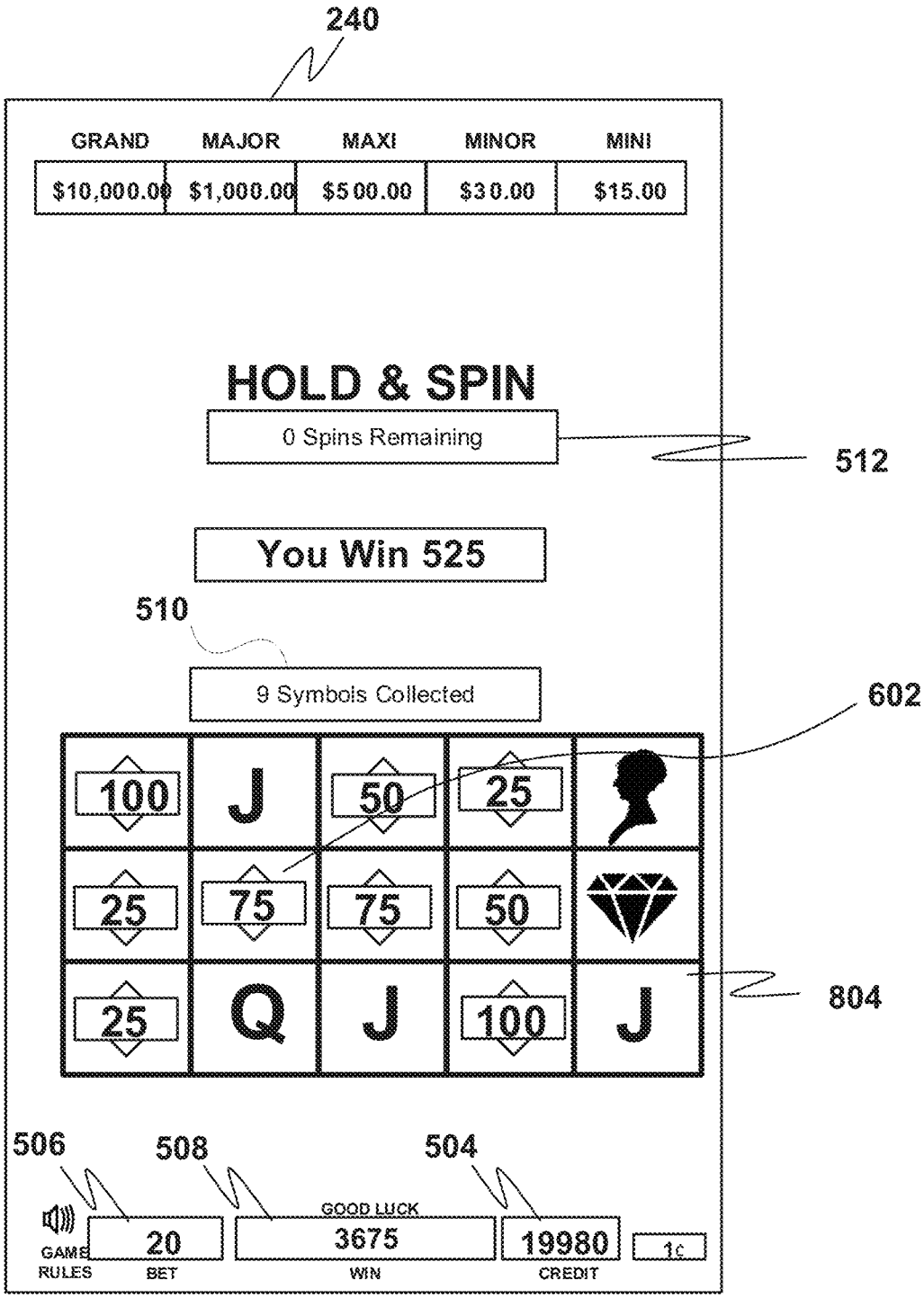

The game controller 202 may proceed with the remaining three (3) spins. In the example of FIG. 8A-8M, the remaining three (3) spins failed to add another configurable symbol 602 to the feature game outcome as shown in FIG. 8M. Accordingly, the game controller 202 may present a final award based on the configurable symbols. Namely, the game controller 202 in one embodiment presents a final award of 475 credits which is the sum of the displayed values for the nine (9) configurable symbols in the feature game outcome The game controller 202 may further add the 475 credits to the other credits already present on the win meter 508 before transferring the credits of the win meter 508 to the credit meter 504.

In some embodiments, the game controller 202 may utilize an animation to present the awards for configurable symbols 602. The animation may visually display the credits from the held configurable symbols 602 being accumulated on a meter, such as the win meter 508. For example, an animation may display rockets (not shown) or other elements sequentially moving from each respective configurable symbol to the win meter 508. When a respective rocket reaches the win meter 508, it may explode and the value from the originating configurable symbol 602 may be added to the win meter 508. When a multiplier is applicable, the animation may be repeated, e.g., twice for a ×2 multiplier, three times for a ×3 multiplier, etc. The award meter 1140 may show the collected credits or the cash equivalent to the collected credits.

In various embodiments, a trigger event may increase the prize values associated with (a) any displayed and held configurable symbols; (b) configurable symbols for the current spin of the feature game; and/or (c) configurable symbols for one or more future spin. This trigger event may be random, based on a symbol or symbol combination, etc. In certain embodiments, the trigger event is based on additional configurable symbols being selected during any outcome of the feature game. In one of the these embodiments, the random boost occurs once per outcome, where one or more additional configurable symbols are selected. In another embodiment, the random boost occurs multiple times per outcome, based on the quantity of additional configurable symbols being selected.

In various embodiments, if no additional configurable symbols are selected during any of the initially awarded spins of the feature game, the game controller 202 may nonetheless provide an award at the end of the feature game which equals the sum of values of the configurable symbols 602 that triggered the feature game.

In various embodiments, the display matrix 804 may be different for the play of the base game than for the feature game. In various embodiments, the symbol set for the base game may differ from the symbol set for the feature game. For example, the base game symbol set may include other traditional symbols used as non-configurable symbols, whereas the feature game symbol set may only have configurable symbols and one type of non-configurable symbol, such as a blank symbol.

Volatility Options

As shown in FIGS. 6A and 8D, the gaming machine 200 may present a quantity of volatility options 540*a*-540*c*. While three options are shown in FIGS. 6A and 8D, the gaming machine 200 in some embodiments may provide a different quantity of volatility options. In general, the player may select one of the volatility options 540*a*-540*c*. The game controller 202 of the gaming machine 200 may use the selected volatility option 540*a*-540*c* to adjust or specify various aspects or control factors of the hold and spin game. Such control factors specified by the selected volatility option 540*a*-540*c* may adjust the volatility of hold and spin game. In particular, the volatility options 540*a*-540*c* may provide a range of volatility for the hold and spin feature. For example, the volatility options 540*a*-540*c* may provide a low volatility option, a high volatility option, and a normal or medium volatility option. The low volatility option may provide smaller awards at a higher frequency, the high volatility option may provide large awards at a lower frequency, and the medium volatility option may provide normal or baseline level awards at a normal or baseline frequency. However, regardless of which volatility option is selected, the gaming machine 200 is designed and/or the game controller 202 is programmed to provide the selected volatility while at the same time ensuring that the return-to-player for each of the volatility options is the same. Namely, regardless of whether the player selects the low volatility option, the normal volatility option, or the high volatility option the player can expect to receive the same return (e.g., 90%) over a significant number of plays of the hold and spin game.

In general, the gaming machine 200 utilizes at least two control factors to provide the requested volatility while maintaining the same return-to-player across the volatility options. In particular, the gaming machine 200 may utilize one control factor to provide the varying volatility across the volatility options and at least another control factor to compensate for the varying volatility in order to provide each volatility option with the same return-to-player. By appropriately specifying and/or implementing such control factors for each of the volatility options, the gaming machine 200 may provide the requested volatility at the same return-to-player.

The following provides implementation details for several volatility implementations. In particular, the following explains different manners of implementing and/or specifying control factors so as to adjust volatility of the hold and spin game while providing the same return-to-player across the range of volatility options.

Volatility Options—Control Factors

In various embodiments, the gaming machine 200 utilizes two primary control factors to adjust volatility while providing the same return-to-player. In particular, the gaming machine 200 uses an expected symbol quantity of configurable symbols, hereafter expected symbols ES, and a multiplier control factor, hereafter multiplier M. The expected symbols ES corresponds to the quantity of configurable symbols that a player can expect to collect on average over a full play of the hold and spin game. In one embodiment, the gaming machine 200 provides a baseline quantity of expected symbols ES for a normal or medium volatility option, greater than the baseline quantity of expected symbols ES for a low volatility option, and less than the baseline quantity of expected symbols ES for the high volatility option.

In one embodiment, the game controller 202 assigns the values to the trigger symbols (see, e.g., 716) and the values to new configurable symbols (see, e.g., 732) in the same manner regardless of the selected volatility option. As such, the expected symbol value EV for each expected symbol ES is the same across the volatility options. In other words, in one embodiment, the average value assigned to the trigger symbols and the average value assigned to the configurable symbols is the same regardless of the selected volatility option.

In such an embodiment, the expected payout P for a play of the hold and spin game is therefore captured by the following equation: $P=EV \times ES \times M$. As such, the gaming machine 200 may maintain the same return-to-player across the volatility options by appropriately specifying of defining the expected value EV, expected symbols ES, and multiplier M for each volatility option such that the expected payout P is the same across for each volatility option.

Per the above, the average value assigned to the trigger symbols (e.g., symbols that triggered the feature) is the same as the average value assigned to the configurable symbols (e.g., additional symbols collected during the feature). However, in other embodiments, the configurable symbols may be assigned a greater value or lesser value on average than the trigger symbols. Since the game controller 202 assigns values to the trigger values per a first average value that is the same across volatility options and assigns values to the configurable symbols per a second average value that is the same across the volatility options, the expected symbol value EV remains the same across the volatility option selected despite the configurable symbols having a different average value than the trigger symbols.

Volatility Options—Repeat Pay—Quantity of Spins

In some embodiments, the gaming machine 200 may provide volatility options 540*a*-540*c* which permit the player to specify the volatility of the hold and spin game by selecting from an initial quantity of spins for the hold and spin game. For example, the volatility options 540*a*-540*c* may permit the player to select from three (3) initial spins, two (2) initial spins, or one (1) initial spin. In some embodiments, a three (3) initial spin game is referred to as a 3-2-1 game, a two (2) initial spin game is referred to as a 2-1 game, and one (1) initial spin game is referred to a 1 game. Such nomenclature is due to the game controller 202 setting the spin meter 510 to the initial quantity of spins and counting down or decrementing the spin meter 510 after each spin. As such, the spin meter 510 for a three (3) initial spin game will count down 3, 2, 1.

In one embodiment, the gaming machine 200 maintains the same odds of landing a configurable symbol at a respective display position (hereafter landing percentage) across the volatility options. As explained above with regard to FIGS. 8A-8M, the gaming machine 200 may provide a separate reel for each display position. Thus, the gaming machine 200 may maintain the same landing percentage for each display position by implementing each reel such that each reel has the same landing percentage (e.g., ⅛). However, in some embodiments, the gaming machine 200 may be implemented such that certain reels have a greater landing percentage (e.g., ⅙) and other reels have a lesser landing percentage (e.g., 1/20). In such embodiments, the gaming machine 200 may distribute the landing percentages across the reels such that the average landing percentage is a desired value (e.g., ⅛). In this manner, the gaming machine 200 may further vary the landing distributions across volatility options, while still maintaining a desired average landing percentage (e.g., ⅛) across the volatility options.

By maintaining the same average landing percentage across volatility options, each spin of the hold and spin game provides an expected quantity of configurable symbols or expected symbols per spin. Since the gaming machine 200 in one embodiment maintains the same landing percentage across the volatility options, the more spins conducted during the hold and spin game, the more configurable symbols are expected to be collected. Thus, a 2-1 game is expected to provide a baseline quantity of spins and thus a baseline expected quantity of additional configurable symbols ES. A 3-2-1 game is expected to provide a greater quantity of spins and thus a greater expected quantity of additional configurable symbols ES. Conversely, 1 game is expected to provide a lesser quantity of spins and thus a lesser expected quantity of additional configurable symbols ES. The expected symbols ES may be determined for each volatility option either through direct mathematical calculation and/or through simulation.

In one embodiment, the game controller 202 assigns values to the trigger symbols and the configurable symbols in the same manner regardless of volatility option. As such, the expected value EV of each trigger symbol and configurable symbol may be determined either through direct mathematical calculation and/or through simulation. Thus, the expected value EV is a known, same value across the volatility options. Conversely, the expected symbols ES is a known, unique value for each of the volatility options. Thus, the expected payout P per the equation P=EV×ES×M may be made constant across the volatility options by selecting an appropriate multiplier M for each volatility option. In one embodiment, the multiplier M is a unique constant value for each volatility option. For example, the low volatility option may have a ×1 multiplier, the normal volatility option may have a ×2 multiplier, and the high volatility option may have a ×3 multiplier.

In other embodiments, the multiplier M for each volatility option is provided by its own range of multipliers and selection criteria such that the average multiplier provides the requisite multiplier M needed to maintain the same return-to-player or expected payout P across the volatility options. For example, the low volatility option may select a multiplier from a ×1 multiplier, a ×2 multiplier, a ×3 multiplier. Each multiplier in the range may be weighted such that the average multiplier for the low volatility option is a determined quantity. For example, a ×1 multiplier may be weighted such that the game controller 202 selects the ×1 80% of the time, a ×2 multiplier may be weight such that it is selected 10% of the time, and a ×3 multiplier may be weight such that it is selected 10% of the time, thus providing the low volatility option with an average multiplier with the determined quantity of 1.3. Similarly, for the medium volatility option, the game controller 202 may select from a ×2 multiplier, a ×3 multiplier, a ×4 multiplier based on respectively assigned weights. For the high volatility option, the game controller 202 may select from a ×4 multiplier, a ×5 multiplier, a ×6 multiplier based on respectively assigned weights. The quantity of multipliers in the range, their values, and the weights are for example purposes only.

In the above embodiments, the game controller 202 assigns values to the additional configurable symbols in the same manner regardless of the volatility option selected. However, in some embodiments, the values selected for the configurable symbols may provide a third control factor for maintaining the same return-to-player or expected payout across volatility options. Such a third control factor may aid in providing a desired or improved gaming experience. For example, an embodiment per the above may need a ×1.1 multiplier M for a low volatility options, ×1.9 multiplier M for a normal volatility option, and a ×3.01 multiplier for a high volatility option. The game designer for aesthetic and/or other reasons would prefer to provide integer multipliers of ×1, ×2, and ×3 for the respective volatility options. By introducing a third control factor, the designer may specify the multipliers M as ×1, ×2, and ×3 and equalize the expected payout P and the return-to-player by appropriately specifying the third control factor.

In such embodiments, the expected payout P may be determined per the equation P=V×CV×ES×M, where V represents the values assigned to the trigger symbols, which is expected to be the same across volatility options, CV represents the average value assigned to the additional configurable symbols collected during the feature, which the game controller 202 may vary across volatility options as the third control factor, ES is the expected additional configurable symbols collected during feature, which is the first control factor that varies across volatility options, and M is the multiplier which is the second control factor that varies across volatility options. In such embodiments, the game designer may determine and/or specify the first control factor ES and the second control factor M in a manner similar to the above and then tweak the third control factor CV such that the game controller 202 assigns values to the additional configurable symbols in a manner that achieves the same return-to-player across volatility options.

Volatility Options—Non-Repeat Pay—Quantity of Spins

The hold and spin game of FIG. 4 does not use the repeat pay process of FIGS. 7A-7C. Instead the game controller 202 presents an award based on the values assigned to collected configurable symbols at either the end of the feature game and/or each time the player fills the matrix with symbols. Similar to the repeat pay embodiments, the game controller 202 may provide volatility options that permit the player to select the quantity of spins. For example, the game controller 202 may provide a low volatility option providing a large quantity of spins (e.g., 120 spins), a normal volatility option providing a baseline or normal quantity of spins (e.g., 60 spins), and a high volatility option providing a small quantity of spins (e.g., 12 spins). The game controller 202 may assign values to the trigger and configurable symbols in the same manner across the volatility options. As such, the game controller 202 maintains the same expected values EV for each configurable symbol across the volatility options. Furthermore, the game controller 202 may vary the landing percentage LP across the volatility options thus varying the expected symbols ES for each volatility option. In this manner, the game controller 202 counteracts the variance in quantity of spins with the variance in the landing percentage LP for each of the configurable symbols across the volatility options.

In light of the above, the expected payout P may be provided by the following equation P=EV×[(ES1×M)+ES2], where ES1 represents the expected quantity of symbols on average in filled matrices, and ES2 represents the expected quantity of symbols on average in an unfilled matrix at the end of the feature. The values for ES1 and ES2 may be obtained through direct mathematical calculation or through simulation. After obtaining the values for ES1 and ES2 for each of the volatility options, an average multiplier M may be assigned to each of the volatility options which causes each of volatility options to provide the same payout or return-to-player on average.

In another embodiment, the game controller 202 may essentially reverse the roles of the expected values EV and landing percentage LP. In particular, the game controller 202 may vary the values assigned to the trigger and configurable symbols across the volatility options. For example, the game controller 202 may assign from a range base values having an expected base line value in response to a normal volatility selection, from a range of higher values having an expected value greater than the expected base line value in response to high volatility selection, and from a range of lower values having an expected value less than the expected base line value in response to low volatility selection. As such, the game controller 202 may vary the expected values EV for each configurable symbol across the volatility options. Furthermore, the game controller 202 may maintain the same the landing percentage LP across the volatility options thus maintaining the expected symbols ES for each volatility option. In this manner, the game controller 202 counteracts the variance in quantity of spins with the variance in the expected values EV for each of the configurable symbols across the volatility options.

Volatility Options—Quantity of Matrices

Figure 9C:
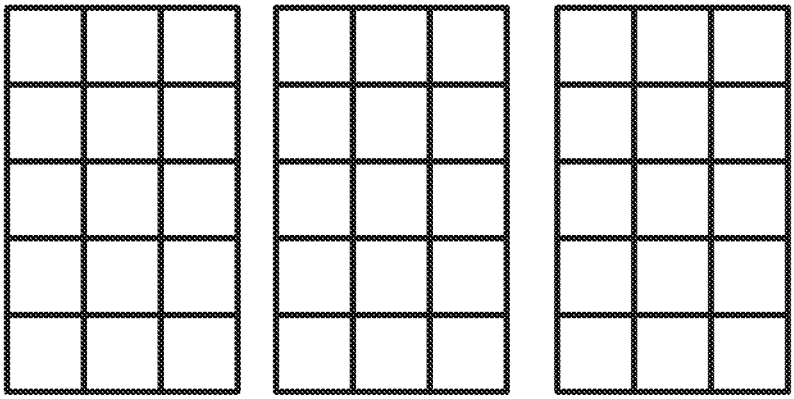
FIGS. 9A-9C respectively present single-up, double-up, and triple-up matrices used by various embodiments of the present disclosure.
Figure 9B:
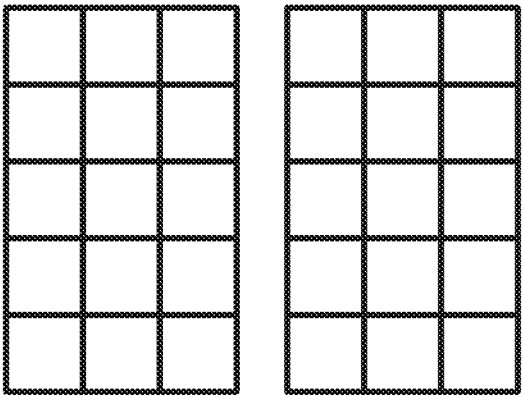
Figure 9A:
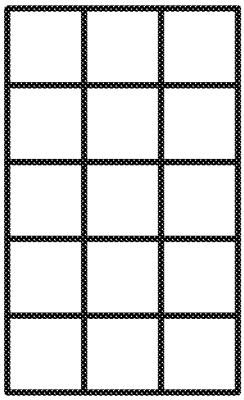

In some embodiments, the game controller 202 may present volatility options that permit the player to select the quantity of matrices in play. For example, FIG. 9A shows a single 3×5 matrix, FIG. 9B shows two 3×5 matrices, and FIG. 9C shows, three 3×5 matrices, which may be respectively referred to as single-up, double-up, or triple-up games. The game controller 202 may maintain the return-to-player across the volatility options by adjusting the multiplier M while leaving other parameters (e.g., landing percentage, quantity of spins, assigned values, etc.) the same. Namely, game controller 202 may provide the single-up game at a first or baseline average multiplier (e.g., 3), the double-up game at a second average multiplier (e.g., 1.5) that is half of the baseline average multiplier; and the triple-up game at a third average multiplier that is a third of the baseline average multiplier. In this manner, the game controller 202 may adjust the frequency at which awards are paid and the size of such awards so as to maintain the same return-to-player across the volatility options.

Volatility Options—Assigned Values

In some embodiments, the game controller 202 may provide volatility options that permit the player to adjust volatility based on assigned values. In such an embodiment, the game controller 202 may provide each volatility option with the same quantity of spins and the same multiplier (e.g., ×1) or no multiplier, but permit the player to select from different expected values. For example, a low volatility option may provide a low average expected value EV (e.g., 50) per symbol, a normal volatility option providing a normal or baseline average expected value EV (e.g., 200), and a high volatility option providing a high average expected value EV (e.g., 500). Per the equation P=EV×ES×M, if expected payout P is to remain constant, the multiplier M is to remain constant, and the expected value EV is to vary, the game controller 202 must appropriately vary the expected symbols ES across the volatility options. The expected symbols ES is dependent on the quantity of spins and the landing percentage. In one embodiment, the game controller 202 maintains the quantity of spins (e.g., 6) constant across the volatility options. In such an embodiment, the game controller 202 may vary the landing percentage appropriately for each volatility option. To this end, the game controller 202 may select reel strips and/or populate reel strips to provide the appropriate average landing percentage for each volatility option.

In some embodiments, the game controller 202 may not reveal and/or assign values to the configurable symbols, which trigger the feature, until after the player has made their volatility selection. By not revealing and/or or assigning values to the configurable symbols, the selection made by the player is not influenced by the values that are ultimately revealed and/or assigned to the configurable symbols that triggered the feature.

Volatility Options—Landing Percentage of Reel Strips

Essentially the converse to the above assigned values option, the game controller 202 may provide volatility options that permit the player to adjust volatility based on landing percentage. In such an embodiment, the game controller 202 may provide each volatility option with the same quantity of spins and the same multiplier (e.g., ×1), but permit the player to select from different landing percentages. For example, a low volatility option may provide a low volatility option which selects reel strips with a high percentage of configurable symbols, a normal volatility option which selects reel strips with a normal or baseline average percentage of configurable symbols, and a high volatility option with provides reel strips with a low percentage of configurable symbols. The expected symbols ES is dependent on the quantity of spins and the landing percentage LP. In one embodiment, the game controller 202 maintains the quantity of spins (e.g., 6) constant across the volatility options. Per the equation P=EV×ES×M, if expect payout P is to remain constant, the multiplier M is to remain constant, and the landing percentage LP is to vary, the game controller 202 must appropriately vary the expected values EV across the volatility options.

Volatility Options—Repeat Pay—Matrix Height

In some repeat pay embodiments, the game controller 202 may provide volatility options that permit the player to adjust volatility based on the height of the matrix. In such embodiment, a low volatility option may provide a large matrix height (e.g., 7×5 matrix) with a small quantity of initial spins (e.g. 2), a normal volatility option may provide a normal or baseline matrix height (e.g., a 5×5 matrix) with a normal or baseline quantity of initial spins (e.g. 3), and a high volatility option may provide a low matrix height (e.g., a 3×5 matrix) with a large initial quantity of spins (e.g. 4). In such an embodiment, the game controller 202 may assign values the same across the volatility options. As noted above, the expected symbols ES is dependent on the quantity of spins S and the landing percentage. Those examples assumed a constant matrix size. The expected symbols ES is further dependent upon the quantity of display positions. In one embodiment, the volatility options increase the initial quantity of spins as the quantity of display positions decrease. As such, the expected symbols ES value may be similar across the volatility options. In such embodiments, the game controller 202 may tweak the assigned values EV and/or the multiplier M to maintain the same expected payout across the volatility options. In one embodiment, the game controller 202 maintains the assigned valued EV the same across the volatility options and varies the multiplier M in order to maintain the same return-to-player.

Volatility Options—General Alternatives

The above provided various examples for maintaining return-to-player across different volatility options. Many of the above examples utilized two primary control factors to provide volatility and maintain return-to-player. In particular, a volatility selection may specify a first control factor and the game controller 202 may utilize a second control factor to maintain the desired return-to-player. It should be appreciated that the control factors of such pairings may be swapped. Namely, the volatility option may specify the second control factor and the game controller 202 may utilize the first control factor to maintain the desire return-to-player. Furthermore, as explained above, a third control factor may be used in some embodiments in order to further tweak the design so that the first control factor and/or the second control factor may be specified to provide desired values (e.g., integer multiplier value, integer spins, etc.)

The following non-exhaustive list provides possible factors that may be used as the first, second, and/or third control factors for a particular embodiment. It should be appreciated that particular embodiments may mix and match the following factors as desired.

- Initial quantity of spins (e.g., 1 spin, 2 spin, 3 spin, etc.)
- Reset quantity of spins (e.g., reset to 1 spin, 2 spin, 3 spin, etc.)
- Varying the Reset quantity of spins (e.g., de-escalation=>first reset to 3, second reset to 2, third reset to 1)
- Number of Reels (3 reels, 4 reels, etc.)
- Matrix size (3×5, 5×7, 10×8, etc.)
- Matrix Arrangement (3-4-3-4, 3-4-5-4-3, etc.)
- Number of Matrices (e.g., single-up, double-up, triple-up, etc.)
- Number of display positions (e.g., 3, 15, 25, etc.)
- Reel height (e.g., reels that provide 1, 2, 3, 4, 5, etc. symbols)
- Reel strips that provide greater or lesser values for configurable symbols
- Reel strips that provide a greater or lesser number or frequency of configurable symbols
- Multipliers to adjust awards
- Multipliers to adjust prize values assigned to configurable symbols Various disclosed embodiments may be embodied in program code. The program code may be supplied in a number of ways, for example, on a non-transitory computer readable storage medium, such as a disc or a memory device, e.g. an EEPROM, (for example, that could replace part of memory 103). In some examples, the program code may be provided via data signals (for example, by transmitting the program code from a server). Further, different parts of the program code can be executed by different devices, for example, in a client-server relationship. Persons skilled in the art will appreciate that program code provides a series of instructions executable by a control system, e.g., via one or more processors.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A gaming machine, comprising:

a player interface;

a credit input mechanism;

a payout mechanism;

a display system comprising one or more display devices; and a control system comprising one or more processors, the control system executing instructions which cause the control system to:

establish a credit balance in response to the credit input mechanism receiving a physical item representing a credit value;

fund a wager amount from the established credit balance in response to initiating play of a base game based on input received via the player interface;

dispense a payout of the credit balance via the payout mechanism;

present symbols of a base game outcome at display positions of the display system;

present volatility options via the display system in response to the base game outcome triggering a feature game;

receive, via the player interface, a volatility selection that selects a volatility option from the volatility options, wherein each volatility option corresponds to a plurality of control factors including an initial quantity of spins for the feature game; and for each spin of the initial quantity of spins specified by the selected volatility option:

hold configurable symbols in a feature game outcome presented at display positions of the display system;

provide the feature game outcome with replacement symbols that replace symbols at display positions of the display system that do not present a configurable symbol;

select a table based on a second control factor of the plurality of control factors, the table storing a plurality of multiplier values; and for each replacement symbol that is a configurable symbol:

select a multiplier value from the selected table and assign the selected multiplier value to the respective configurable symbol; and present an award for the respective configurable symbol based on a sum of values presented by the configurable symbols multiplied by the multiplier value assigned to the respective configurable symbol.

2. The gaming machine of claim 1, wherein the instructions cause the control system to:

trigger the feature game in response to the base game outcome including a threshold quantity of trigger symbols; and in response to triggering the feature game, replace the trigger symbols of the base game outcome with held configurable symbols in the feature game outcome.

3. The gaming machine of claim 2, wherein the instructions cause the control system to randomly assign a value to each held configurable symbols independent of the volatility selection.

4. The gaming machine of claim 1, wherein the instructions cause the control system to assign a value to the respective configurable symbol after presenting the award for the respective configurable symbol, wherein the control system assigns the value in a manner that is independent of the volatility selection.

5. The gaming machine of claim 1, wherein the instructions cause the control system to assign a value to a first configurable symbol of the feature game outcome after presenting the award for the first configurable symbol, wherein the control system assigns the value in a manner that varies the assigned values based on the volatility selection in order to maintain the same return-to-player across the volatility options.

6. The gaming machine of claim 1, wherein the instructions cause the control system to select the replacement symbols based on reel strips that maintain a same landing percentage for configurable symbols across the volatility options.

7. The gaming machine of claim 1, wherein the instructions cause the control system to select the replacement symbols based on reel strips that vary a landing percentage for configurable symbols across the volatility options in order to maintain the same return-to-player across the volatility options.

8. A method of a gaming machine, the method comprising:

establishing a credit balance in response to a credit input mechanism of the gaming machine receiving a physical item representing a credit value;

funding a wager amount from the established credit balance in response to initiating play of a base game based on input received via a player interface of the gaming machine;

dispensing a payout of the credit balance via a payout mechanism of the gaming machine;

presenting symbols of a base game outcome at display positions of a display system of the gaming machine;

presenting volatility options via the display system in response to the base game outcome triggering a feature game;

receiving, via the player interface, a volatility selection that selects a volatility option from the volatility options, wherein each volatility option corresponds to a plurality of control factors including an initial quantity of spins for the feature game; and for each spin of the initial quantity of spins specified by the selected volatility option:

holding, with a control system of the gaming machine, configurable symbols in a feature game outcome presented at display positions of the display system;

providing, with the control system, the feature game outcome with replacement symbols that replace symbols at display positions of the display system that do not present a configurable symbol;

select, with the control system, a table based on a second control factor of the plurality of control factors, the table storing a plurality of multiplier values; and for each replacement symbol that is a configurable symbol:

selecting, with the control system, a multiplier value from the selected table;

assigning, with the control system, the selected multiplier value to the respective configurable symbol; and presenting, via the display system, an award for the respective configurable symbol based on a sum of values presented by the configurable symbols multiplied by the multiplier value assigned to the respective configurable symbol.

9. The method of claim 8, comprising:

trigger, with the control system, the feature game in response to the base game outcome including a threshold quantity of trigger symbols; and in response to triggering the feature game, replacing, with control system, the trigger symbols of the base game outcome with held configurable symbols in the feature game outcome.

10. The method of claim 9, comprising randomly assign, with the control system, a value to each held configurable symbols independent of the volatility selection.

11. The method of claim 8, comprising assigning, with the control system independent of the volatility selection, a value to the respective configurable symbol after presenting the award for the respective configurable symbol.

12. The method of claim 8, comprising:

assigning, with the control system, a value to a first configurable symbol of the feature game outcome after presenting the award for the first configurable symbol;

wherein the assigning assigns the value in a manner that varies the assigned values based on the volatility selection in order to maintain the same return-to-player across the volatility options.

13. The method of claim 8, comprising selecting, with the control system, the replacement symbols based on reel strips that maintain a same landing percentage for configurable symbols across the volatility options.

14. The method of claim 8, comprising selecting, with the control system, the replacement symbols based on reel strips that vary a landing percentage for configurable symbols across the volatility options in order to maintain the same return-to-player across the volatility options.

15. A non-transitory computer readable medium comprising instructions that in response to being executed cause a gaming machine to:

establish a credit balance in response to a credit input mechanism of the gaming machine receiving a physical item representing a credit value;

fund a wager amount from the established credit balance in response to initiating play of a base game based on input received via a player interface of the gaming machine;

dispense a payout of the credit balance via a payout mechanism of the gaming machine;

present symbols of a base game outcome at display positions of a display system of the gaming machine;

present volatility options via the display system in response to the base game outcome triggering a feature game;

receive, via the player interface, a volatility selection that selects a volatility option from the volatility options, wherein each volatility option corresponds to a plurality of control factors including an initial quantity of spins for the feature game; and for each spin of the initial quantity of spins specified by the selected volatility option:

hold configurable symbols in a feature game outcome presented at display positions of the display system;

provide the feature game outcome with replacement symbols that replace symbols at display positions of the display system that do not present a configurable symbol;

select a table based on a second control factor of the plurality of control factors, the table storing a plurality of multiplier values; and for each replacement symbol that is a configurable symbol:

select a multiplier value from the selected table;

assign the selected multiplier value to the respective configurable symbol; and present an award for the respective configurable symbol based on a sum of values presented by the configurable symbols multiplied by the multiplier value assigned to the respective configurable symbol.

16. The non-transitory computer readable medium of claim 15, wherein execution of the instructions causes the gaming machine to:

trigger the feature game in response to the base game outcome including a threshold quantity of trigger symbols; and in response to triggering the feature game, replace the trigger symbols of the base game outcome with held configurable symbols in the feature game outcome.

17. The non-transitory computer readable medium of claim 16, wherein execution of the instructions causes the gaming machine to randomly assign a value to each held configurable symbols independent of the volatility selection.

18. The non-transitory computer readable medium of claim 15, wherein execution of the instructions causes the gaming machine to assign, independent of the volatility selection, a value to the respective configurable symbol after presenting the award for the respective configurable symbol.

19. The non-transitory computer readable medium of claim 15, wherein execution of the instructions causes the gaming machine to select the replacement symbols based on reel strips that maintain a same landing percentage for configurable symbols across the volatility options.

20. The non-transitory computer readable medium of claim 15, wherein execution of the instructions causes the gaming machine to select the replacement symbols based on reel strips that vary a landing percentage for configurable symbols across the volatility options in order to maintain the same return-to-player across the volatility options.

* * * * *